US008692719B2

(12) United States Patent
Yagi et al.

(10) Patent No.: US 8,692,719 B2
(45) Date of Patent: Apr. 8, 2014

(54) MULTIBAND ANTENNA AND ELECTRONIC DEVICE

(75) Inventors: Shigeru Yagi, Tokyo (JP); Yuki Kotaka, Tachikawa (JP)

(73) Assignee: Casio Computer Co., Ltd., Tokyo (JP)

( * ) Notice: Subject to any disclaimer, the term of this patent is extended or adjusted under 35 U.S.C. 154(b) by 182 days.

(21) Appl. No.: 13/259,801

(22) PCT Filed: Mar. 18, 2010

(86) PCT No.: PCT/JP2010/054644
§ 371 (c)(1),
(2), (4) Date: Sep. 23, 2011

(87) PCT Pub. No.: WO2010/110162
PCT Pub. Date: Sep. 30, 2010

(65) Prior Publication Data

US 2012/0013510 A1 Jan. 19, 2012

(30) Foreign Application Priority Data

Mar. 24, 2009 (JP) ..... 2009-072081
Nov. 24, 2009 (JP) ..... 2009-266118
Mar. 12, 2010 (JP) ..... 2010-055201

(51) Int. Cl.
*H01Q 1/38* (2006.01)

(52) U.S. Cl.
USPC ..... 343/700 MS; 343/702; 343/846

(58) Field of Classification Search
USPC ..... 343/702, 700 MS, 846
See application file for complete search history.

(56) References Cited

U.S. PATENT DOCUMENTS 6,031,505 A 2/2000 Qi et al.
6,384,799 B1 * 5/2002 Otomo et al. ..... 343/895
6,891,506 B2 5/2005 Jarmuszewski et al.
6,985,114 B2 1/2006 Egashira
7,023,387 B2 4/2006 Wen et al.
7,057,560 B2 6/2006 Erkocevic
7,183,984 B2 2/2007 Jarmuszewski et al.
7,256,741 B2 8/2007 Wen et al.
7,358,902 B2 4/2008 Erkocevic
8,111,200 B2 2/2012 Yagi et al.

(Continued)

FOREIGN PATENT DOCUMENTS

CN 1574456 A 2/2005
CN 1720640 A 1/2006

(Continued)

OTHER PUBLICATIONS

International Search Report dated Jun. 22, 2010 issued in International Appln. No. PCT/JP2010/054644.

(Continued)

*Primary Examiner* — Dieu H Duong
(74) *Attorney, Agent, or Firm* — Holtz, Holtz, Goodman & Chick

(57) ABSTRACT

A multiband antenna includes a conductive antenna element portion and a conductive ground element portion which are provided on an insulating film. The antenna element portion includes a first antenna element having a length corresponding to a first resonance frequency, and a second antenna element having a length corresponding to a second resonance frequency. The ground element portion includes a first side having a length to resonate at the first resonance frequency, and a second side having a length to resonate at the second resonance frequency.

16 Claims, 25 Drawing Sheets

(56) References Cited

U.S. PATENT DOCUMENTS

| | | | |
|---|---|---|---|
| 2004/0246188 | A1 | 12/2004 | Egashira |
| 2006/0049990 | A1 | 3/2006 | Watada et al. |
| 2006/0119517 | A1 | 6/2006 | Futamata |
| 2006/0145923 | A1 | 7/2006 | Autti |

FOREIGN PATENT DOCUMENTS

| | | | |
|---|---|---|---|
| EP | 1 475 859 | A1 | 11/2004 |
| EP | 1 478 047 | A1 | 11/2004 |
| EP | 2 128 925 | A1 | 12/2009 |
| JP | 6-69715 | A | 3/1994 |
| JP | 10-093332 | A | 4/1998 |
| JP | 2007-013596 | A | 1/2007 |
| JP | 2007-14021 | A | 1/2007 |
| JP | 2008-527773 | A | 7/2008 |
| WO | WO 00/02028 | A1 | 1/2000 |
| WO | WO 04/001898 | A1 | 12/2003 |
| WO | WO 2006/070233 | A1 | 7/2006 |

OTHER PUBLICATIONS

Extended European Search Report (EESR) dated Nov. 21, 2012 (in English) issued in counterpart European Application No. 10755960.1.

Chinese Office Action dated Jul. 24, 2013 (and English translation thereof) in counterpart Chinese Application No. 2010800137305.

* cited by examiner

MULTIBAND ANTENNA AND ELECTRONIC DEVICE

This application is a U.S. National Phase Application under 35 USC 371 of International Application PCT/JP2010/054644 filed Mar. 18, 2010.

TECHNICAL FIELD

The present invention relates to a multiband antenna and an electronic device.

BACKGROUND ART

Traditionally, there has been known a portable device such as a handheld terminal and a personal digital assistant (PDA) with a radio communication function. There has been proposed a plane-shaped multiband antenna as an antenna for radio communication to be mounted on the portable device (e.g., see Patent document 1). The multiband antenna can easily be stored in a portable device owing to the plane-shape, and radio communication can be performed at a plurality of resonance frequencies with the multiband antenna.

Further, there has been known an inverted F antenna having an inverted F antenna element as an antenna for radio communication. Furthermore, a multiband inverted F antenna has been proposed as well (e.g., see Patent document 2).

PRIOR ART DOCUMENTS

Patent Documents

Patent Document 1: Japanese Patent Publication Laid-Open No. 2007-13596

Patent Document 2: Japanese Patent Publication Laid-Open No. H10-93332

DISCLOSURE OF INVENTION

Problems to be Solved by the Invention

In the conventional art, an inverted F antenna utilizes a frame ground of a portable device as the antenna ground when being mounted on a portable device. It has been desired that the mounting space is as small as possible to downsize the portable device. Consequently, the antenna is to be mounted close to the frame ground of the portable device. Here, when a distance between the frame ground of the portable device and the antenna is small, a phenomenon of capacitor coupling occurs between the frame ground and the antenna. The capacitor coupling denotes a capacitor component occurring between the frame ground and the antenna. There has been a problem of worsening of the radiation efficiency of the antenna itself due to occurrence of power loss at the antenna caused by the capacitor component.

Accordingly, it has been desired to obtain high antenna gain without utilizing a frame ground of a portable device as the ground necessary for the antenna in a case where a distance between the frame ground of the portable device and the antenna is small in order to downsize a portable device.

An object of the present invention is to obtain high antenna gain without utilizing a frame ground of a portable device as the ground necessary for an antenna.

Means for Solving Problems

In order to solve the above-mentioned problem, a multiband antenna according to the present invention comprises: a conductive antenna element portion and a conductive ground element portion which are on an insulating film, wherein the antenna element portion includes a first antenna element having a length corresponding to a first resonance frequency, and a second antenna element having a length corresponding to a second resonance frequency; and the ground element portion includes a first side having a length to resonate at the first resonance frequency, and a second side having a length to resonate at the second resonance frequency.

Further, in the multiband antenna according to the present invention, the antenna element portion is preferably arranged around a dielectric portion.

Further, the multiband antenna according to the present invention preferably further comprises a separating portion which fixes the antenna element portion and the dielectric portion to each other with a certain distance therebetween.

Further, in the multiband antenna according to the present invention, the dielectric portion preferably has a substantially rectangular-parallelepiped shape.

Further, in the multiband antenna according to the present invention, the dielectric portion preferably has a shape corresponding to a place where the dielectric portion is attached.

Further, in the multiband antenna according to the present invention, the dielectric portion preferably includes an edge portion having a curved surface which corresponds to deformation of the antenna element portion.

Further, in the multiband antenna according to the present invention, the dielectric portion preferably includes at least one first space portion.

Further, in the multiband antenna according to the present invention, the antenna element portion is preferably an inverted F antenna having a plurality of resonance frequency bands, and the antenna element portion includes a plurality of impedance-matching loop routes.

Further, in the multiband antenna according to the present invention, the antenna element portion preferably includes: a first short stub which is connected to the ground element portion; a first antenna element, one end of which is connected to one end of the first short stub; a second antenna element, one end of which is connected to the first short stub, and which is arranged between the ground element portion and the first antenna element; a second short stub which is arranged separately from the first short stub by a predetermined distance and which is connected to the first antenna element and the second antenna element; and a third short stub which is arranged separately from the first short stub by a predetermined distance and which is connected to a power feeding point and the second antenna element.

Further, in the multiband antenna according to the present invention, the first antenna element preferably includes two sides, whose lengths are different from each other, between a portion connected to the first short stub and an end thereof; and the second antenna element includes two sides, whose lengths are different from each other, between a portion connected to the first short stub and an end thereof.

Further, in the multiband antenna according to the present invention, the first side of the ground element portion preferably has a length equal to or larger than $\lambda/4$ of a center frequency of a first resonance frequency band and the second side, which is a shorter side, of the ground element portion has a length equal to or larger than $\lambda/4$ of a center frequency of a second resonance frequency band, wherein $\lambda$ denotes a wavelength of a radio wave.

Further, in the multiband antenna according to the present invention, the ground element portion preferably includes a second space portion arranged at a position avoiding an internal component of an electronic device to which the multiband antenna is attached.

Further, in the multiband antenna according to the present invention, both faces of the antenna element portion and the ground element portion are preferably covered with the film.

Further, in the multiband antenna according to the present invention, the antenna element portion and the ground element portion are preferably on a single film.

An electronic device according to the present invention comprises: the multiband antenna; a communication unit which performs radio communication with an external device via the multiband antenna; and a control unit which controls the communication unit.

Effects of the Invention

According to the present invention, high antenna gain can be obtained without utilizing a frame ground of a portable device as the ground necessary for an antenna.

EMBODIMENTS FOR CARRYING OUT THE INVENTION

Figure 1A:
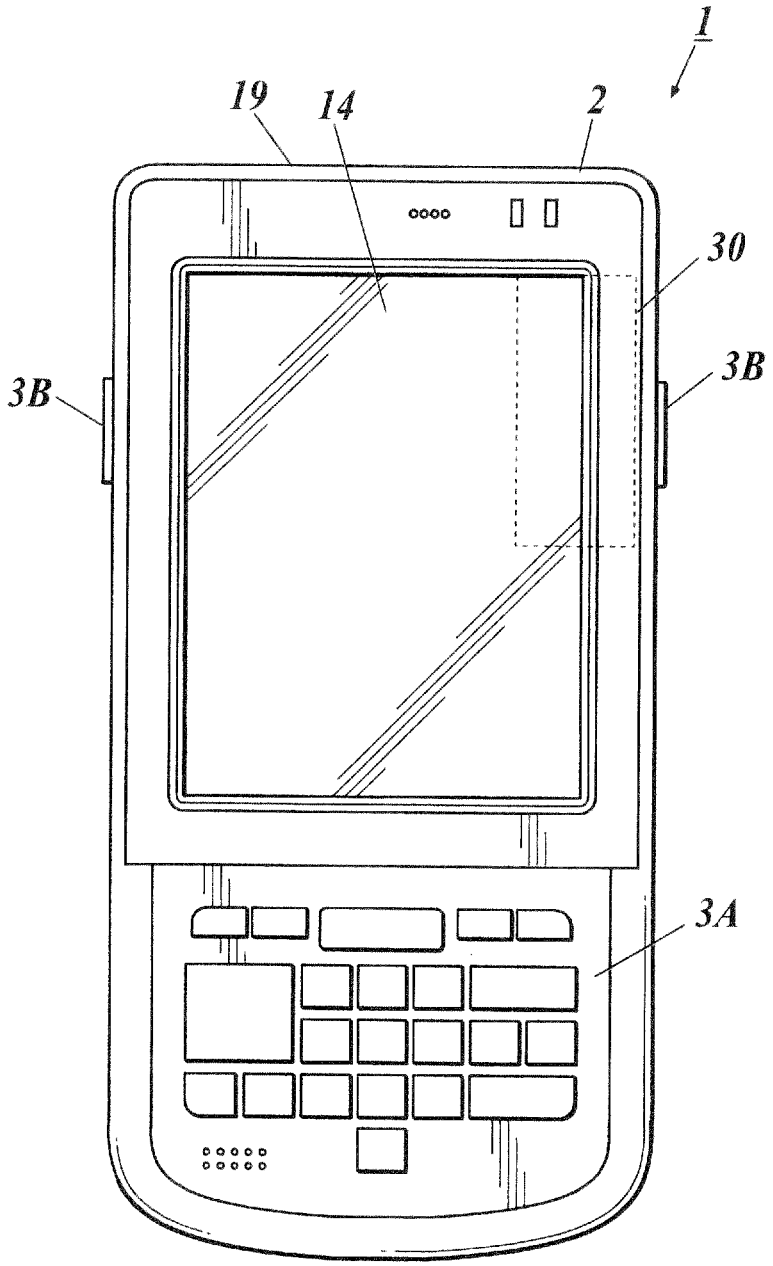
FIG. 1A is a front view of a handheld terminal of a first embodiment according to the present invention.

In the following, description will be performed in detail on a first embodiment, first and second modified examples thereof and a second embodiment according to the present invention preferable thereto with reference to the attached drawings. Here, the present invention is not limited to examples illustrated in the drawings.

First Embodiment

Figure 1B:
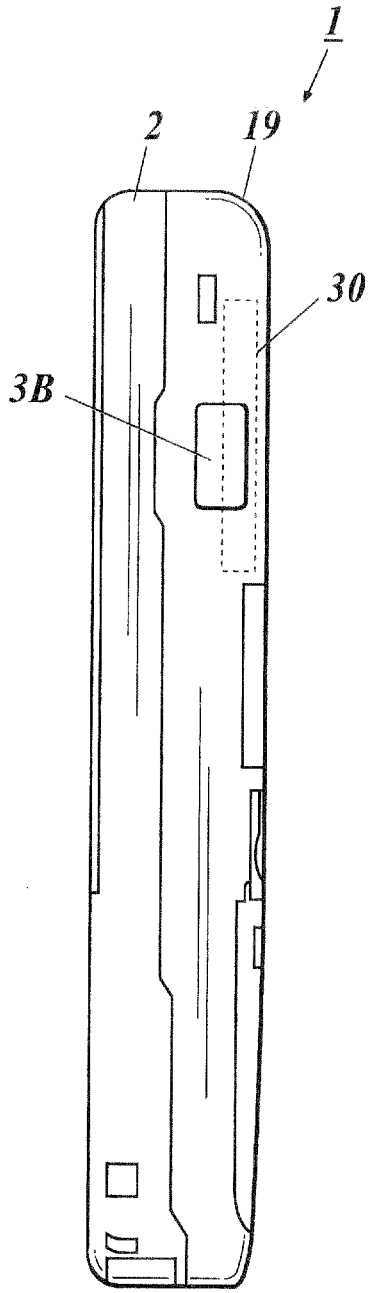
FIG. 1B is a side view of the handheld terminal of the first embodiment.

In the following, a first embodiment according to the present invention will be described with reference to FIGS. 1 to 13. First, a device structure of the present embodiment will be described with reference to FIGS. 1 to 6. FIG. 1A illustrates a front structure of a handheld terminal 1 of the present embodiment. FIG. 1B illustrates a side structure of the handheld terminal 1.

The handheld terminal 1 as an electronic device of the present embodiment is a portable terminal having functions of information inputting, information storing, bar-code scanning and the like with a user's operation. Further, the handheld terminal 1 has a function of performing radio communication with an external device via an access point with a radio local area network (LAN) method and a cellular phone communication function with a global system for mobile communications (GSM).

As illustrated in FIG. 1A, the handheld terminal 1 is provided with a display unit 14, a variety of keys 3A and the like at a front face of a case 2. Further, as illustrated in FIG. 1B, the handheld terminal 1 is provided with a trigger key 3B at each side face of the case 2 and a scanner unit 19 at a top end of the case. Further, the handheld terminal 1 is provided with a multiband antenna 30 at the inside of the case 2.

The variety of keys 3A include keys for inputting characters such as numerals, keys for various functions, and the like. The trigger key 3B is a key which receives trigger operation input of light irradiating and bar-code scanning of a later-mentioned scanner unit 19. It is also possible that the variety keys 3A include a trigger key for light irradiating and bar-code scanning of the scanner unit 19. The scanner unit 19 is a component which reads bar-code data by irradiating light such as laser light to a bar-code and receiving and binarizing reflected light thereof.

Figure 2:
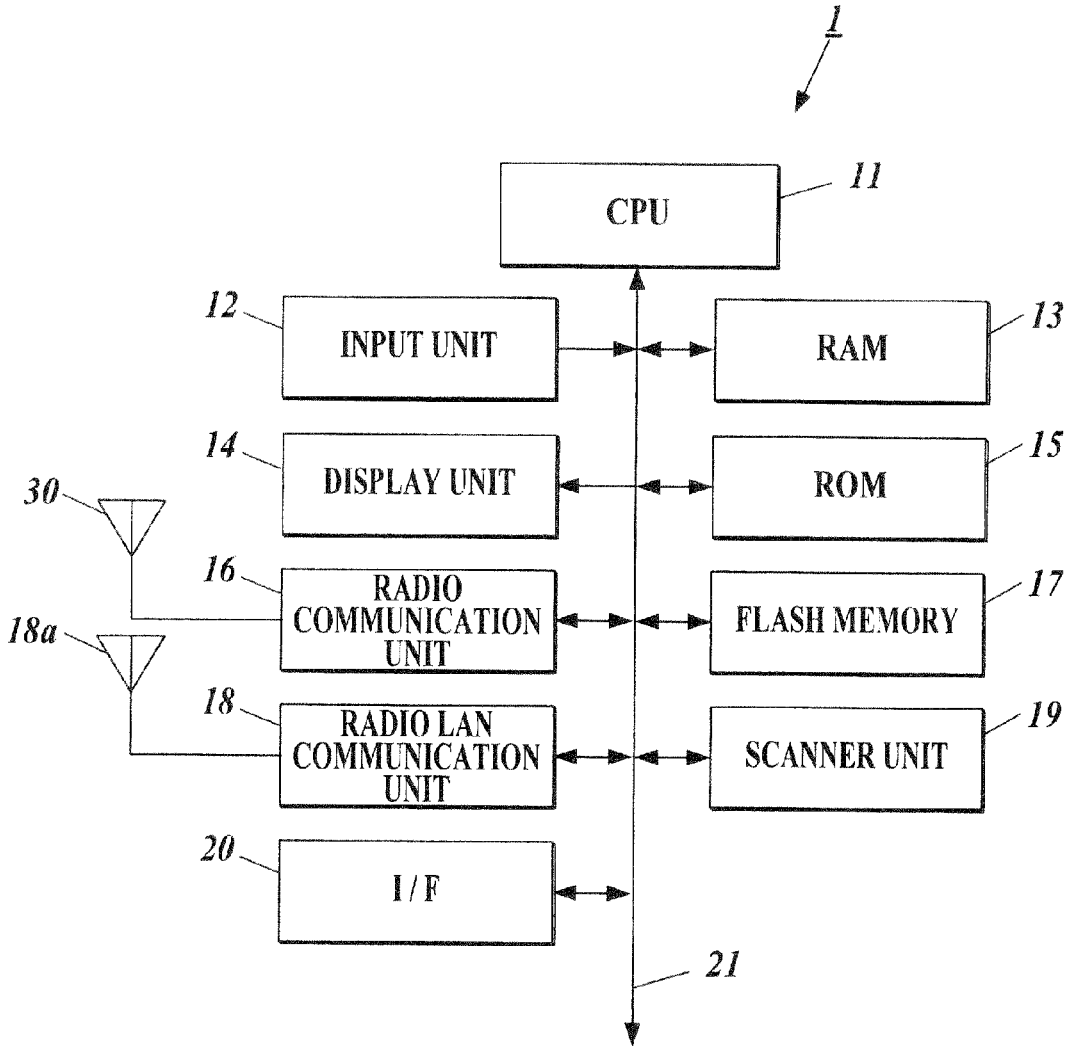
FIG. 2 is a block diagram illustrating a function structure of the handheld terminal of the first embodiment.

FIG. 2 illustrates a functional structure of the handheld terminal 1. As illustrated in FIG. 2, the handheld terminal 1 is provided with a central processing unit (CPU) 11 as a control unit, an input unit 12, a random access memory (RAM) 13, the display unit 14, a read only memory 15 (ROM), a multiband antenna 30, a radio communication unit 16 as a communication unit, a flash memory 17, an antenna 18*a*, a radio LAN communication unit 18, the scanner unit 19, an interface (I/F) 20 and the like. The CPU 11, the input unit 12, the RAM 13, the display unit 14, the ROM 15, the radio communication unit 16, the flash memory 17, the radio LAN communication unit 18, the scanner unit 19 and the I/F 20 are connected with one another via a bus 21.

The multiband antenna 30 is an antenna for a cellular phone function. The multiband antenna 30 is an antenna having a structure in which a dielectric portion having a substantially rectangular-parallelepiped shape is wrapped with a film antenna.

The CPU 11 controls each portion of the handheld terminal 1. The CPU 11 extracts, into the RAM 13, a system program and a program specified out of a variety of application programs stored in the ROM 15, and then, executes a variety of processes in cooperation with the programs extracted into the RAM 13.

The CPU 11 receives input of operational information via the input unit 12 in cooperation with a variety of programs and reads various information from the ROM 15 while performing reading and writing of various information against the flash memory 17. In addition, the CPU 11 performs communication with a base station (or an external device linked thereby) via the radio communication unit 16 and the multiband antenna 30 and performs communication with an access point (or an external device linked thereby) using the radio LAN communication unit 18 and the antenna 18*a*. Further, the CPU 11 reads bar-code data with the scanner unit 19 and performs wire communication with an external device via the I/F 20.

The input unit 12 includes the various keys 3A and the trigger key 3B and outputs a key input signal of each key input by being pressed by an operator to the CPU 11. It is also possible that the input unit 12 is structured as a touchscreen touch pad integrally with the display unit 14.

The RAM 13 is a volatile memory which temporarily stores information and includes a work area which stores various programs to be executed, data related to the various programs, and the like. The display unit 14 is constituted with a liquid crystal display (LCD), an electroluminescent display (ELD) or the like and performs various displaying in accordance with display signals from the CPU 11.

The ROM 15 is a memory portion in which various programs and various data are stored only for being read.

The radio communication unit 16 is connected to the multiband antenna 30 and performs transmitting and receiving of information against a base station with GSM method communication using the multiband antenna 30. In the present embodiment, the radio communication unit 16 is described as a radio communication unit which performs multiband radio communication of which frequency bands are approximately between 824 and 960 MHz (hereinafter, called a first resonance frequency band) and between 1710 and 1990 MHz (hereinafter called a second resonance frequency band) utilized for a communication method of a GSM cellular phone. The multiband antenna 30 is a multiband antenna which is matched to these two frequency bands. However, not limited to the above, the multiband antenna 30 and the radio communication unit 16 may be structured to perform radio communication in another resonance communication band and with another radio communication method.

The flash memory 17 is a storage unit capable of reading and writing of information of various data and the like.

The radio LAN communication unit 18 is connected to the antenna 18*a* and performs transmitting and receiving of information with an access point with a radio LAN communication method via the antenna 18*a*.

The scanner unit 19 includes a light emitting section of laser light and the like, a light receiving section, a gain circuit, a binarizing circuit, and the like. In the scanner unit 19, light output from the light emitting section is irradiated to a bar-code, the reflected light is received by the light receiving section and transformed into an electric signal and then, the electric signal is transformed into data of the bar-code in black and while by the binarizing circuit after being amplified by the gain circuit. In this manner, the scanner unit 19 reads a bar-code image and outputs data of the bar-code image to the CPU 11.

The I/F 20 performs transmitting and receiving of information with an external device via a communication cable. For example, the I/F 20 is a wire communication portion of a universal serial bus (USB) type.

Figure 3:
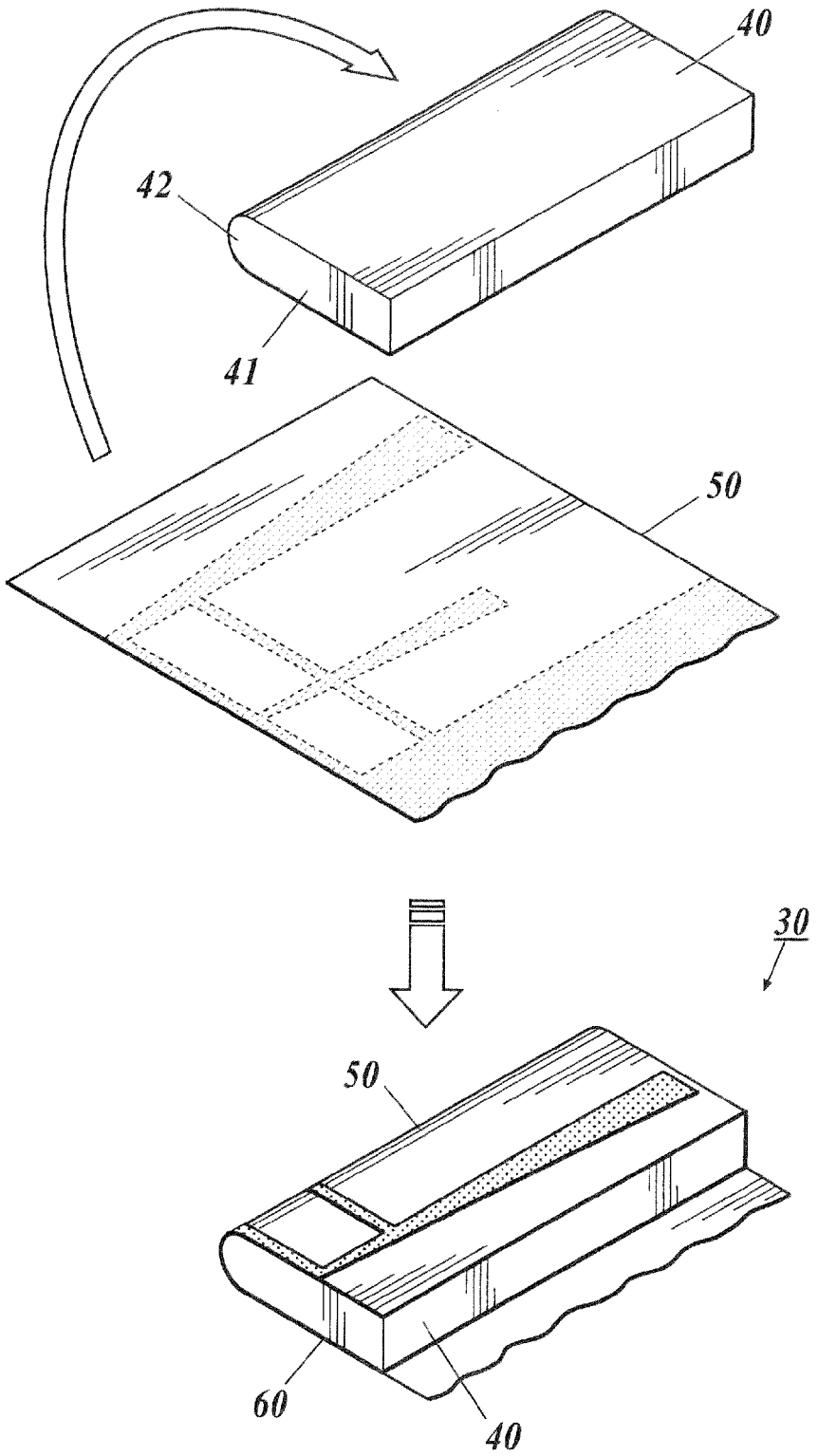
FIG. 3 is a view illustrating a structure of a multiband antenna according to the first embodiment.
Figure 4:
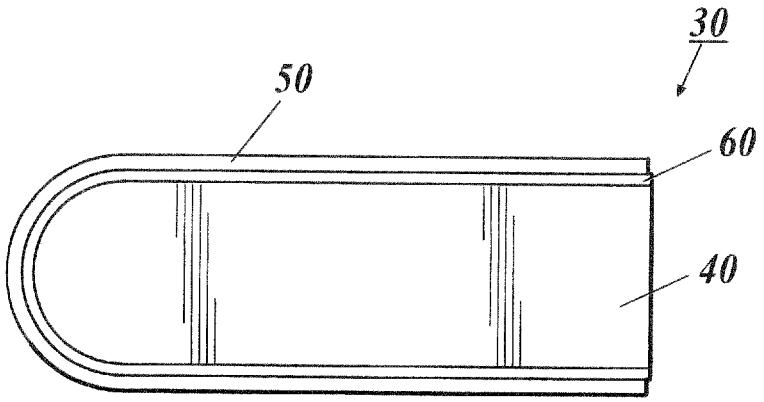
FIG. 4 is a side view of the multiband antenna of the first embodiment.

Next, a structure of the multiband antenna 30 will be described with reference to FIGS. 3 to 6. FIG. 3 illustrates the structure of the multiband antenna 30. FIG. 4 illustrates a side face structure of the multiband antenna 30.

As illustrated in FIG. 3, the multiband antenna 30 includes a dielectric portion 40, a film antenna portion 50, and a double-faced tape 60 as a separating portion. The dielectric portion 40 is made of dielectric material and has a plate-like shape (a block shape) as a shape corresponding to a place where the dielectric portion 40 is attached in the case 2. The dielectric portion 40 includes a block body section 41 which has a substantially rectangular-parallelepiped shape. A round-shaped edge portion 42 which corresponds to deformation of the film antenna portion 50 is formed at the block body section 41. The edge portion 42 is a leading end of the block body section 41 as being processed into a round shaped. The dielectric portion 40 is formed by casting of dielectric resin. The dielectric resin is obtained by mixing ceramic powder with resin such as poly phenylen sulfide resin (PPS) and liquid crystal polymer (LCP). An (effective) relative permittivity of the dielectric resin is adjusted in accordance with a mixed amount of the ceramic powder. In the present embodiment, explanation is made assuming that the effective relative permittivity of the dielectric portion 40 $\in_{eff}$ is 5. However, it is not limited to this value.

The film antenna portion 50 has a film shape and is an antenna portion having flexibility.

The film antenna portion 50 is wound around and attached to the dielectric portion 40 along a surface shape including a surface of the edge portion 42. Specifically, as illustrated in FIG. 4, the film antenna portion 50 is wound around and attached to the dielectric portion 40 via the double-faced tape 60. The edge portion 42 is arranged so that an adhesion gap does not exist with the film antenna portion 50 wound around the dielectric portion 40. Further, the double-faced tape 60 is arranged at the entire contact surface between the dielectric portion 40 and the film antenna portion 50.

The double-faced tape 60 has uniform thickness. In addition, it is preferable that the double-faced tape 60 does not influence largely to effective relative permittivity of the dielectric portion 40. The double-faced tape 60 includes a strip-shaped base material and a layer of adhesive arranged at each face of the base material. For example, the double-faced tape 60 adopts a nonwoven textile as the base material and adopts pressure-sensitive adhesive, which generates adhesion by being pressed, as the adhesive. For example, the adhesive is an acrylic-base adhesive. For example, the thickness of the double-faced tape 60 is 0.16 mm including a peel liner.

It is also possible to utilize a thick material such as acrylic foam as the base material of the double-faced tape 60. With this structure, the thickness of the double-faced tape 60 is 2 mm including a peel liner, for example. Here, the material and quality of the double-faced tape 60 are not limited to the above.

Since the thickness of the double-faced tape 60 is uniform, a gap length between the film antenna portion 50 and the dielectric portion 40 is kept at a certain distance. The double-faced tape 60 makes it easy to stick the film antenna portion 50 to the dielectric portion 40.

Here, the distance between the dielectric portion 40 and (an antenna element of) the film antenna portion 50 is varied by varying thickness of the double-faced tape 60, so that the effective relative permittivity of the dielectric portion 40 can be varied.

Figure 5:
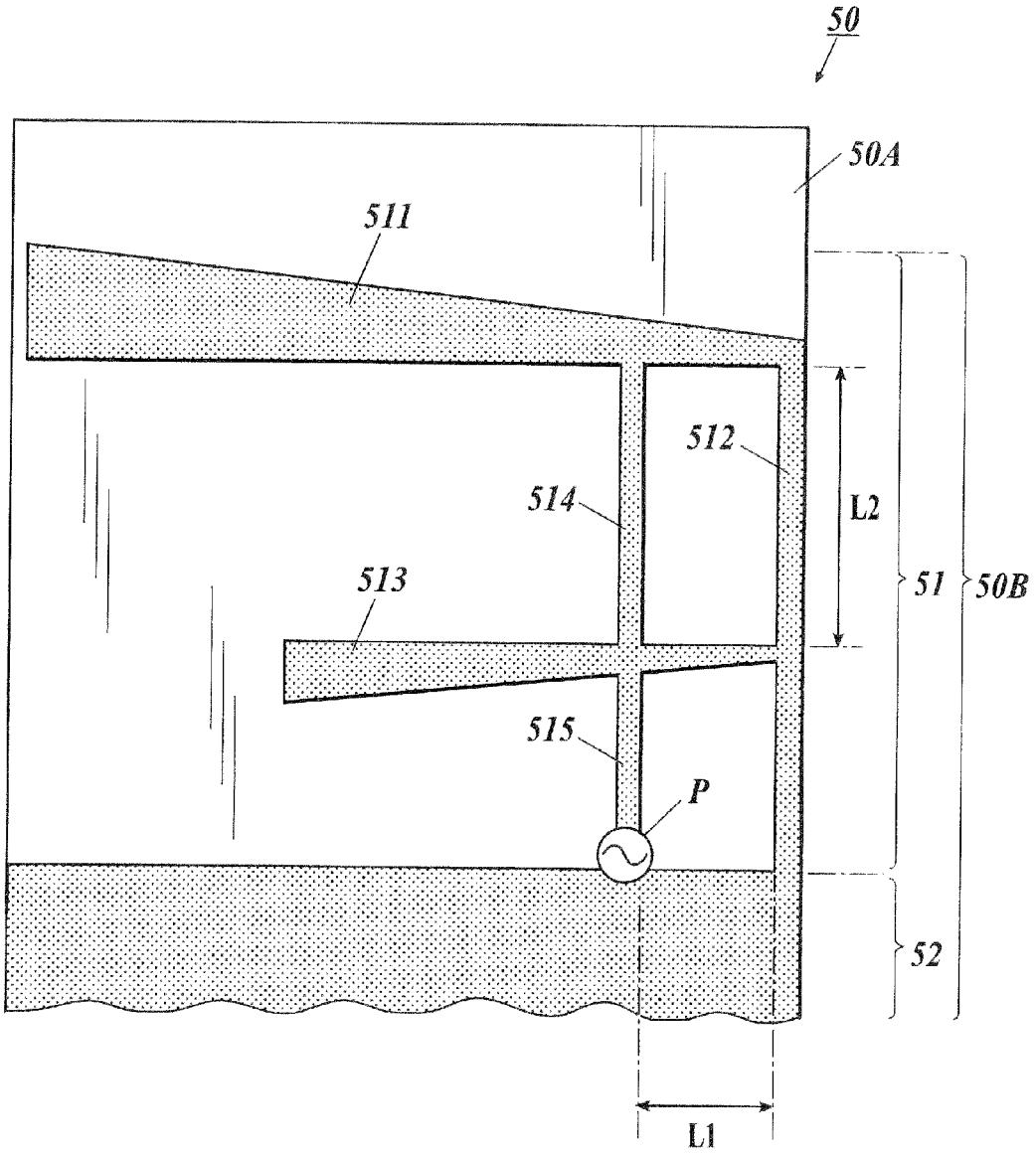
FIG. 5 is a plane view of a film antenna portion.

FIG. 5 illustrates a plane structure of the film antenna portion 50. As illustrated in FIG. 5, the film antenna portion 50 includes a film 50A and an antenna conducting portion 50B. The film 50A is a film of a flexible print circuit (FPC) and is formed of insulating material such as polyimide. The antenna conducting portion 50B is constituted with a planar conducting material such as copper foil formed on the film 50A.

The antenna conducting portion 50B is a so-called inverted F antenna and includes an antenna element portion 51 and a ground portion 52. The antenna conducting portion 50B includes the antenna element portion 51 and the ground portion 52. The antenna element portion 51 is a section which is connected to a core wire of a coaxial cable for power feeding. The ground portion 52 is a section to be connected to the ground side of the coaxial cable. A section corresponding at least to the antenna element portion 51 is stuck to the dielectric portion 40 via the double-faced tape 60.

The antenna element portion 51 includes an antenna element 511 as a first antenna element, a short stub 512 as a first short stub, an antenna element 513 as a second antenna element, a short stub 514 as a second short stub, and a short stub 515 as a third short stub. The antenna element 511 is a trapezoid-shaped (a wedge-shaped) antenna element and is arranged so that a lower side thereof is in parallel to an upper side of the ground portion 52. Further, one end of the antenna element 511 is connected to the short stub 512. Furthermore, the antenna element 511 has two sides, whose lengths are different from each other, between the portion connected to the short stub 512 and the other end thereof.

The short stub 512 is a strip-shaped (rectangle-shaped) antenna element and is arranged so that the longitudinal direction thereof is vertical to the upper side of the ground portion 52. Further, one end of the short stub 512 is connected to the antenna element 511 and the other end thereof is connected to the ground portion 52.

The antenna element 513 is a trapezoid-shaped (a wedge-shaped) antenna element and is arranged so that an upper side thereof is in parallel to the upper side of the ground portion 52. Further, one end of the antenna element 513 is connected to the short stub 512. Furthermore, the antenna element 513 has two sides, whose lengths are different from each other, between the portion connected to the short stub 512 and the other end thereof.

The short stub 514 is a strip-shaped (rectangle-shaped) antenna element and is arranged so that the longitudinal direction thereof is vertical to the upper side of the ground portion 52 and so that the short stub 514 is apart from the short stub 512 by a predetermined distance. Further, one end of the short stub 514 is connected to the antenna element 511 and the other end thereof is connected to the antenna element 513.

The short stub 515 is a strip-shaped (rectangle-shaped) antenna element and is arranged so that the longitudinal direction thereof is vertical to the upper side of the ground portion 52 and so that the short stub 515 is apart from the short stub 512 by a predetermined distance. Here, the extending direction (i.e., the longitudinal direction) of the short stub 515 and the extending direction of the short stub 514 are on the same straight line. Further, one end of the short stub 515 is connected to the antenna element 513 while the other end thereof is not connected to the ground portion 52. The other end of the short stub 515 and a part of the ground portion 52 which faces the other end are connected to a later-mentioned coaxial cable 70. The connection point is denoted as a power feeding point P.

The ground portion 52 is electrically connected to a frame ground (not illustrated) disposed in the case 2 by being screwed with a screw and the like. The frame ground is made of metal (i.e., conducting material) such as magnesium alloy and aluminum and is electrically grounded.

The length of the ground portion of the multiband antenna 30 in the longitudinal direction is required to be equal to or larger than a quarter of a radiowave wavelength $\lambda$ of a center frequency 892 MHz at the 800 MHz band (i.e., the first resonance frequency band). The wavelength $\lambda$ of the center frequency 892 MHz is 0.3363 m. Therefore, the length of the ground portion in the longitudinal direction is required to be 8.4 cm (i.e., $\lambda/4$) or larger.

The width (the shorter side) of the ground portion of the multiband antenna 30 is required to be equal to or larger than a quarter of a radiowave wavelength $\lambda$ of a center frequency 1850 MHz at the 1800 MHz band (i.e., the second resonance frequency band). The wavelength $\lambda$ of the center frequency 1850 MHz is 0.1621 m. Therefore, the width of the ground portion is required to be 4 cm (i.e., $\lambda/4$) or larger.

Here, the ground portion 52 does not have a size of 8.4 cm or larger in the longitudinal direction and 4 cm or larger in width but is connected to a frame ground having a size of 8.4 cm or larger in the longitudinal direction and 4 cm or larger in width. Accordingly, area required for the ground of the multiband antenna 30 is ensured by the ground portion 52 and the frame ground. Here, it is also possible to electrically connect the ground portion 52 to the ground of a printed circuit board (PCB) instead of the frame ground.

Here, the distance between the short stub 512 and the short stubs 514, 515 is denoted by distance L1. The distance between the antenna element 511 and the antenna element 513 is denoted by distance L2. Distances L1, L2 will be described later.

Figure 6:
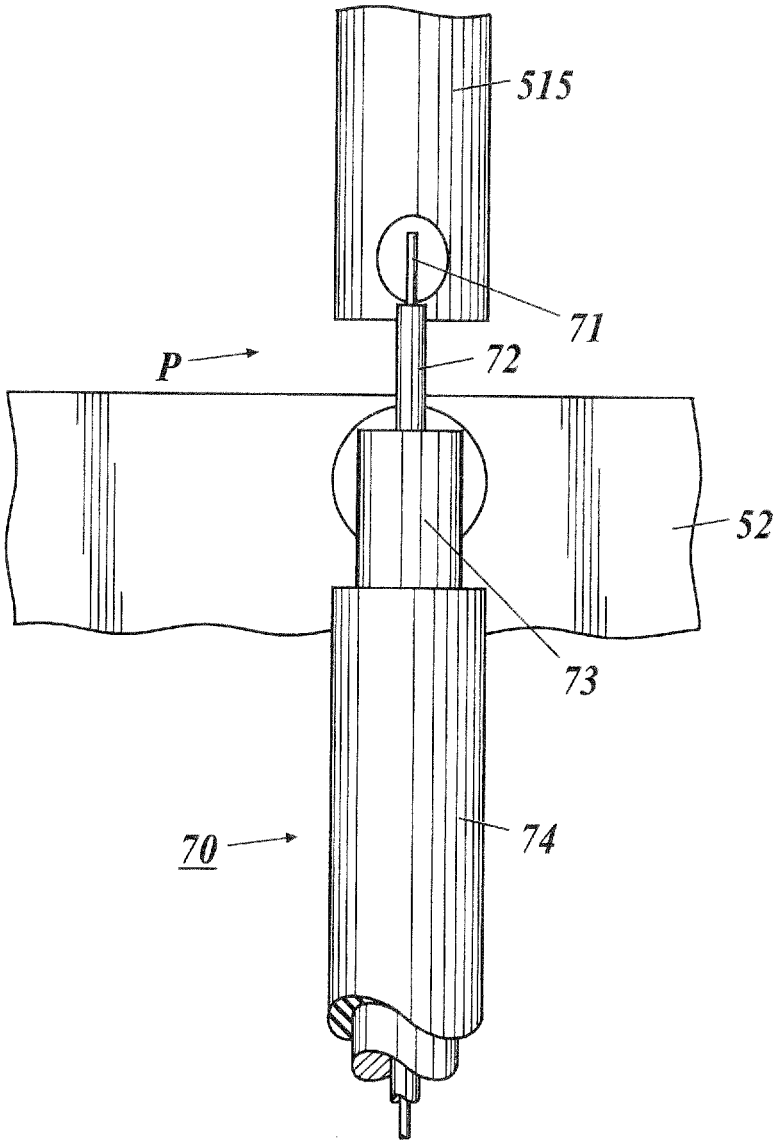
FIG. 6 is a view illustrating a connection structure between the film antenna portion and a coaxial cable.

Next, connection at the power feeding point P between the film antenna portion 50 of the multiband antenna 30 and the coaxial cable 70 will be described with reference to FIG. 6. FIG. 6 illustrates a connection structure between the film antenna portion 50 and the coaxial cable 70. In FIG. 6, the film 50A is omitted.

The coaxial cable 70 includes a core wire 71 such as a copper wire, an insulating material 72 such as polyethylene, an external conducting body 73 such as a mesh-shaped copper wire, and a protection cover portion 74 as an insulating material coaxially in order thereof outward from the center of a section (i.e. a face perpendicular to an extending direction). The core wire 71 at one end of the coaxial cable 70 is connected to the short stub 515 by soldering. The external conducting body 73 is connected to the ground portion 52 by soldering.

The other end of the coaxial cable 70 is connected to the radio communication unit 16. Specifically, the core wire 71 at the other end of the coaxial cable 70 is connected to a power feeding terminal of a GSM module (not illustrated) of the radio communication unit 16 and the external conducting body 73 is also connected to the ground of the GSM module.

High-frequency electric power is fed to the power feeding point P from the GSM module of the radio communication unit 16 via the coaxial cable 70.

Next, the multiband antenna 30 will be described in detail. In the multiband antenna 30, a shortening rate of elements (i.e., the antenna elements and short stubs) of the film antenna portion 50 due to the dielectric portion 40 is calculated by following equation (1) by utilizing the effective relative permittivity $\in_{eff}$ of the dielectric portion 40. The effective relative permittivity $\in_{eff}$ is determined owing to thickness of the dielectric portion 40 and positional relation (i.e., whether being on the surface or at the inside) between the dielectric portion 40 and the elements of the film antenna portion 50.

$$\text{Shortening rate}=1/(\in_{eff})^{1/2} \quad (1)$$

For fine adjustment of a resonance point (i.e., a resonance frequency) of the multiband antenna 30, intentional control of the effective relative permittivity $\in_{eff}$ of the dielectric portion 40 can provide the same effect as varying a length of an element of the film antenna portion 50, so that the resonance frequency of the element of the film antenna portion 50 can be varied.

Varying of the effective relative permittivity $\in_{eff}$ of the dielectric portion 40 can be actualized by varying thickness of the double-faced tape 60 and varying a distance between the dielectric portion 40 and the elements of the film antenna portion 50. The thickness of the double-faced tape 60 can be varied by varying the number of tapes used for the double-faced tape 60, i.e., by sticking one tape, two tapes, three tapes, or the like. Alternatively, the thickness of the double-faced tape 60 can be varied by using a tape having different thickness for the double-faced tape 60.

More specifically, the resonance frequency of the film antenna portion 50 is shifted to a higher frequency by enlarging the thickness of the double-faced tape 60 and the resonance frequency of the film antenna portion 50 is shifted to a lower frequency by lessening the thickness of the double-faced tape 60. In this manner, fine adjustment of the resonance frequency of the multiband antenna 30 can be performed by varying the thickness of the double-faced tape 60.

Figure 7:
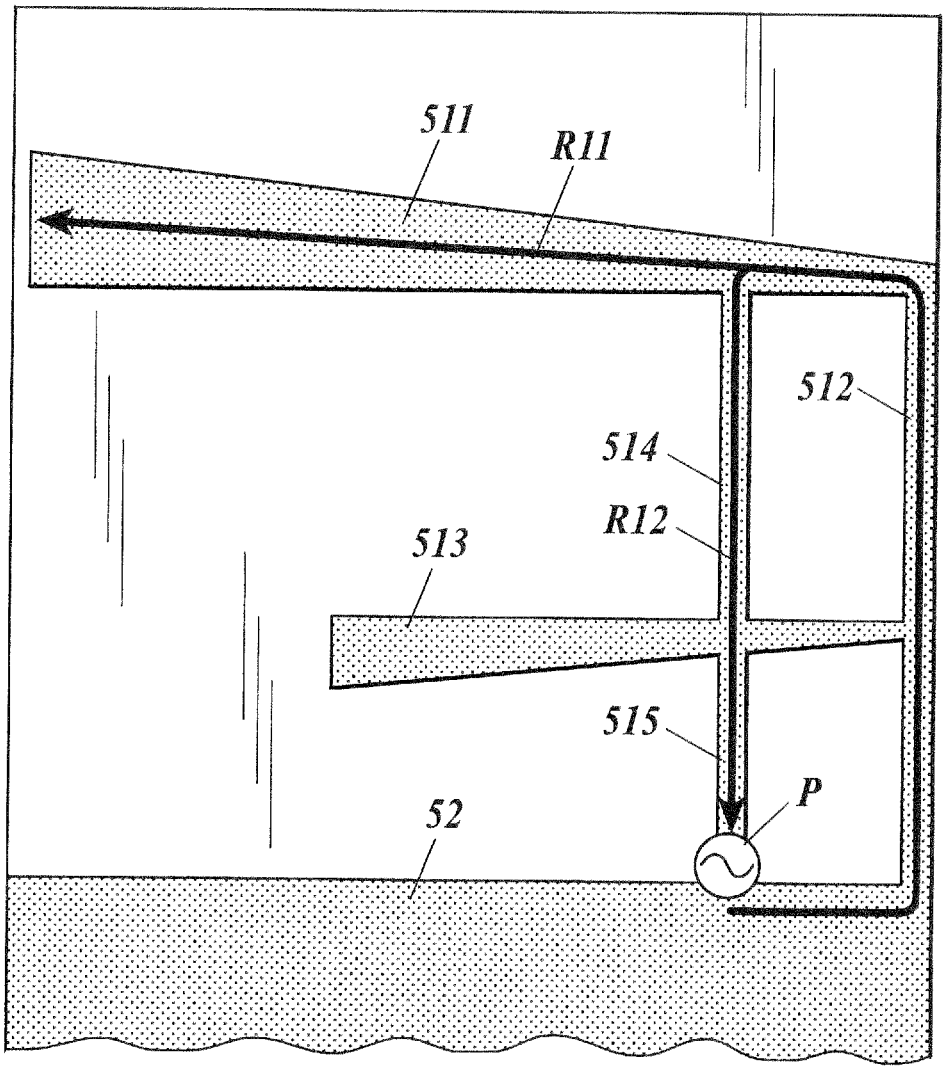
FIG. 7 is a view illustrating a route of antenna current at the time of resonance in a first resonance frequency band of the multiband antenna.
Figure 8:
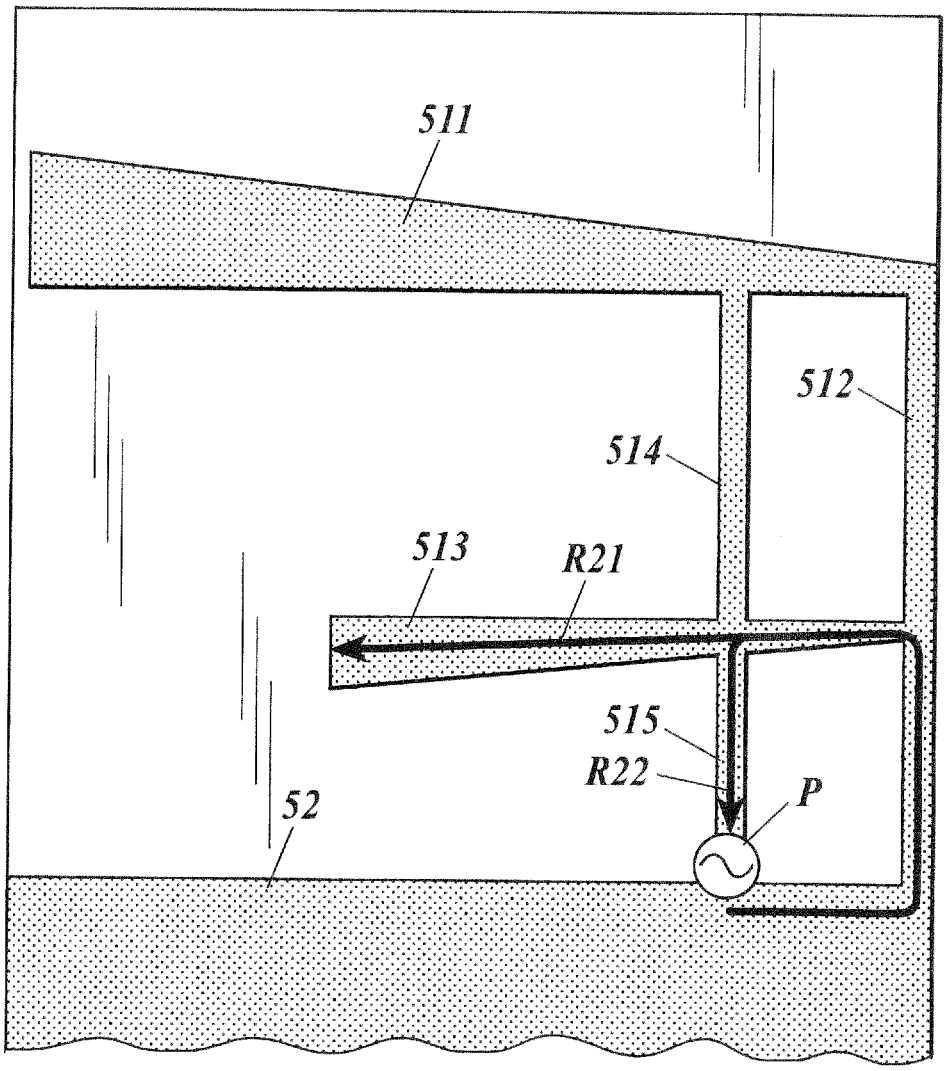
FIG. 8 is a view illustrating a route of antenna current at the time of resonance in a second resonance frequency band of the multiband antenna.

Next, multiband characteristics and impedance matching of the multiband antenna 30 will be described with reference to FIGS. 7 to 11. FIG. 7 illustrates routes R11, R12 of antenna current at the time of resonance in the first resonance frequency band of the multiband antenna 30. FIG. 8 illustrates routes R21, R22 of antenna current at the time of resonance in the second resonance frequency band of the multiband antenna 30.

As illustrated in FIG. 7, in the multiband antenna 30, the antenna current at the time of resonance in the first resonance frequency band flows on the route R11 for resonance in the order of the power feeding point P, the ground portion 52, the short stub 512 and the antenna element 511 and on the impedance-matching loop route R12 in the order of the power feeding point P, the ground portion 52, the short stub 512, the antenna element 511, the short stub 514, the short stub 515 and the power feeding point P. The length of the short stub 512 and the antenna element 511 on the route R11 for resonance is set to be λ/4.

As illustrated in FIG. 8, in the multiband antenna 30, the antenna current at the time of resonance in the second resonance frequency band flows on the route R21 for resonance in the order of the power feeding point P, the ground portion 52, the short stub 512 and the antenna element 513 and on the impedance-matching loop route R22 in the order of the power feeding point P, the ground portion 52, the short stub 512, the antenna element 513, the short stub 515 and the power feeding point P. The length of the short stub 512 and the antenna element 513 on the route R21 for resonance is set to be λ/4.

In this manner, the multiband antenna 30 includes the two routes R11, R21 for resonance and the two impedance-matching loop routes R12, R22. Owing to the two routes R11, R12 for resonance, the multiband antenna 30 has multiband characteristics with the two resonance frequency bands (i.e., the first and second resonance frequency bands).

Figure 9:
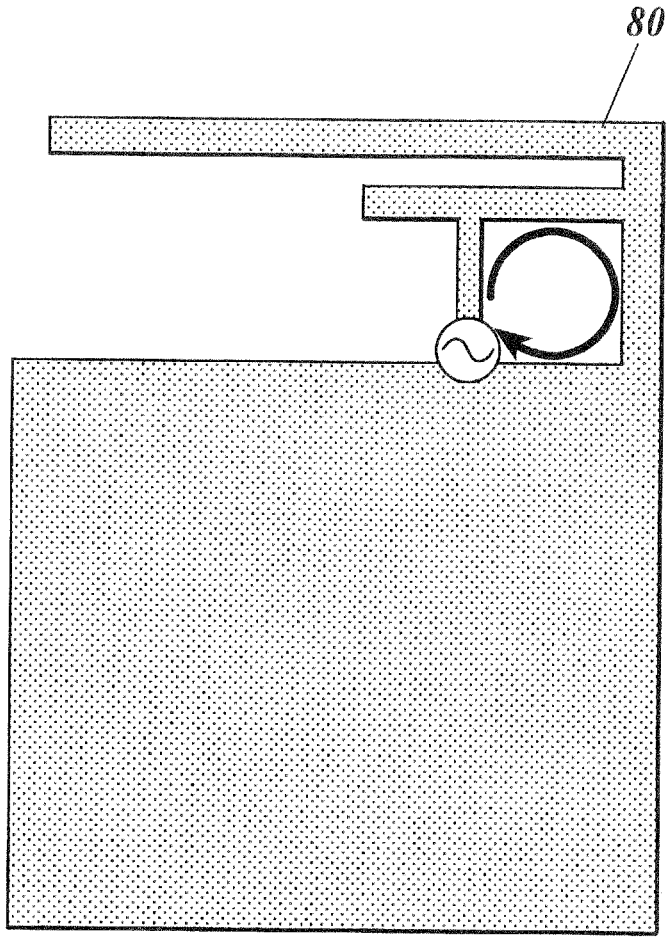
FIG. 9 is a plane view of an inverted F antenna in the conventional art.
Figure 10:
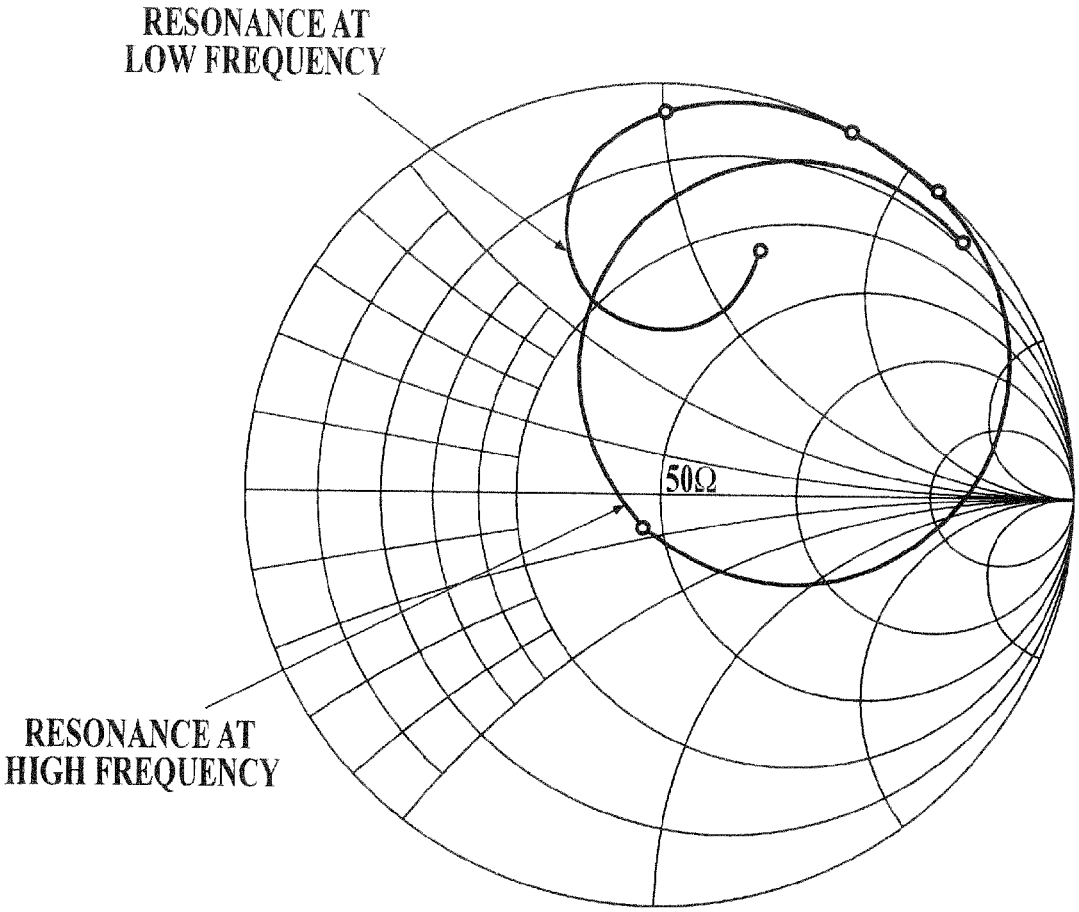
FIG. 10 is a smith chart of the inverted F antenna in the conventional art.

Here, an example of a multiband inverted F antenna in the conventional art will be described. FIG. 9 illustrates a plane structure of a multiband inverted F antenna 80 in the conventional art. FIG. 10 is a smith chart of the inverted F antenna 80.

A multiband inverted F antenna in the conventional art has included one impedance-matching loop route as a route of the inverted F antenna 80 as illustrated by an arrow in FIG. 9. The inverted F antenna 80 includes two resonance frequency bands. Here, as illustrated in FIG. 10, in a case of performing impedance matching in the two resonance frequency bands, a shape and a length of the inverted F antenna 80 are to be set so that impedance of a resonance section at a high frequency (i.e., in the higher resonance frequency band) is matched approximately to 50Ω. In this case, a resonance section at a low frequency (i.e., in the lower resonance frequency band) has a large L-component while impedance thereof is not matched to 50Ω. In this manner, with the inverted F antenna 80, it has been difficult to perform impedance matching in two resonance frequency bands.

Figure 11:
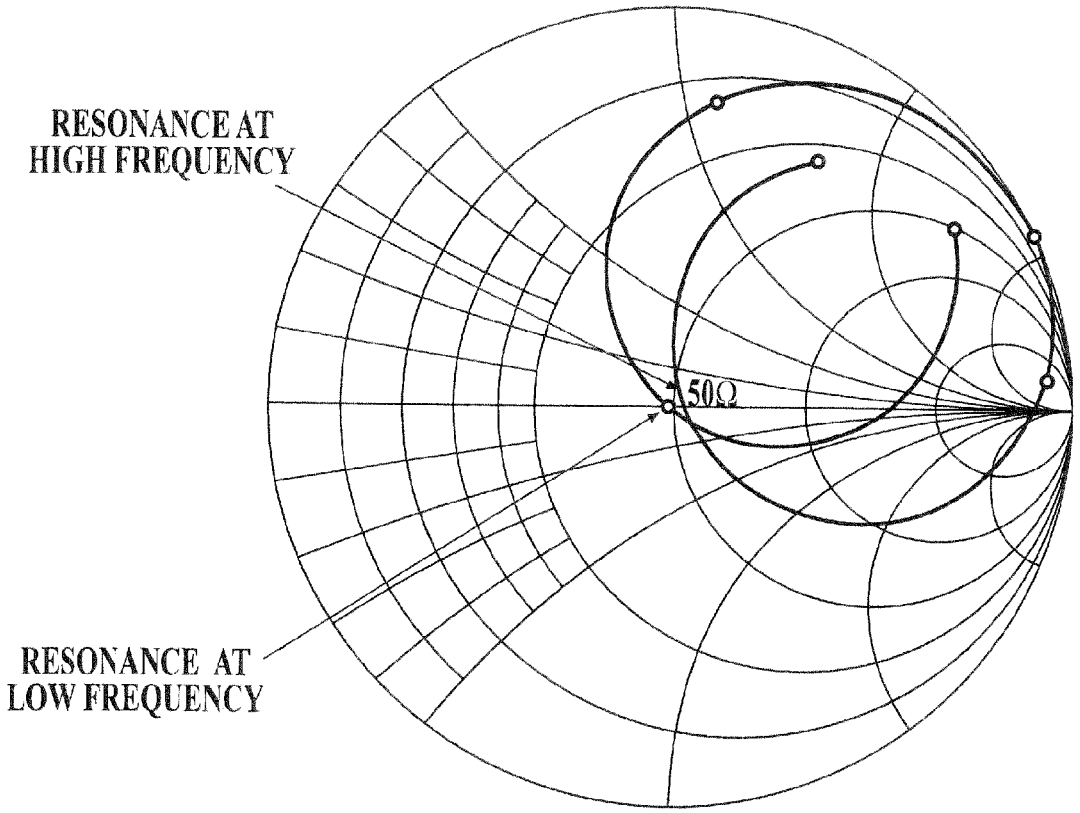
FIG. 11 is a smith chart of the multiband antenna of the first embodiment.

FIG. 11 is a smith chart of the multiband antenna 30. The multiband antenna 30 includes the two impedance-matching loop routes R12, R22. In impedance matching of the multiband antenna 30, impedance matching is performed firstly for a high frequency (i.e., in the second resonance frequency band) by varying the distance L1 (i.e., varying positions of the short stubs 514, 515 against the short stub 512) as illustrated in FIG. 5.

Then, impedance matching is performed for a low frequency (i.e. in the first resonance frequency band) by varying the distance L2 (i.e., varying a position of the antenna element 513 against the antenna element 511). In this manner, it is required to perform impedance matching for the low frequency after performing impedance matching for the high frequency.

Accordingly, as illustrated in FIG. 11, in the multiband antenna 30, the impedance of a resonance section at the low frequency (i.e., in the first resonance frequency band) can be matched approximately to 50Ω while the impedance of a resonance section at the high frequency (i.e., in the second resonance frequency band) can be matched approximately to 50Ω.

Figure 12:
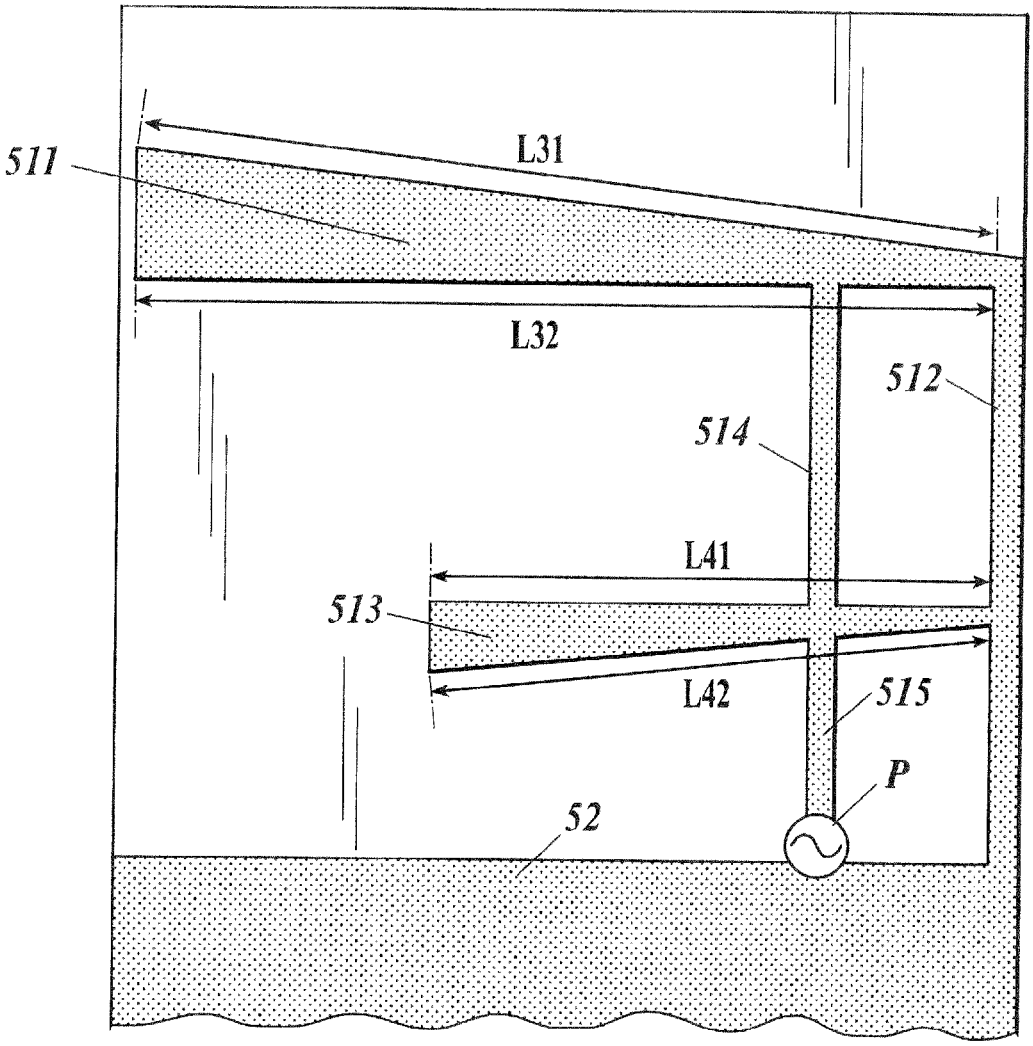
FIG. 12 is a view illustrating lengths of sides of antenna elements.
Figure 13:
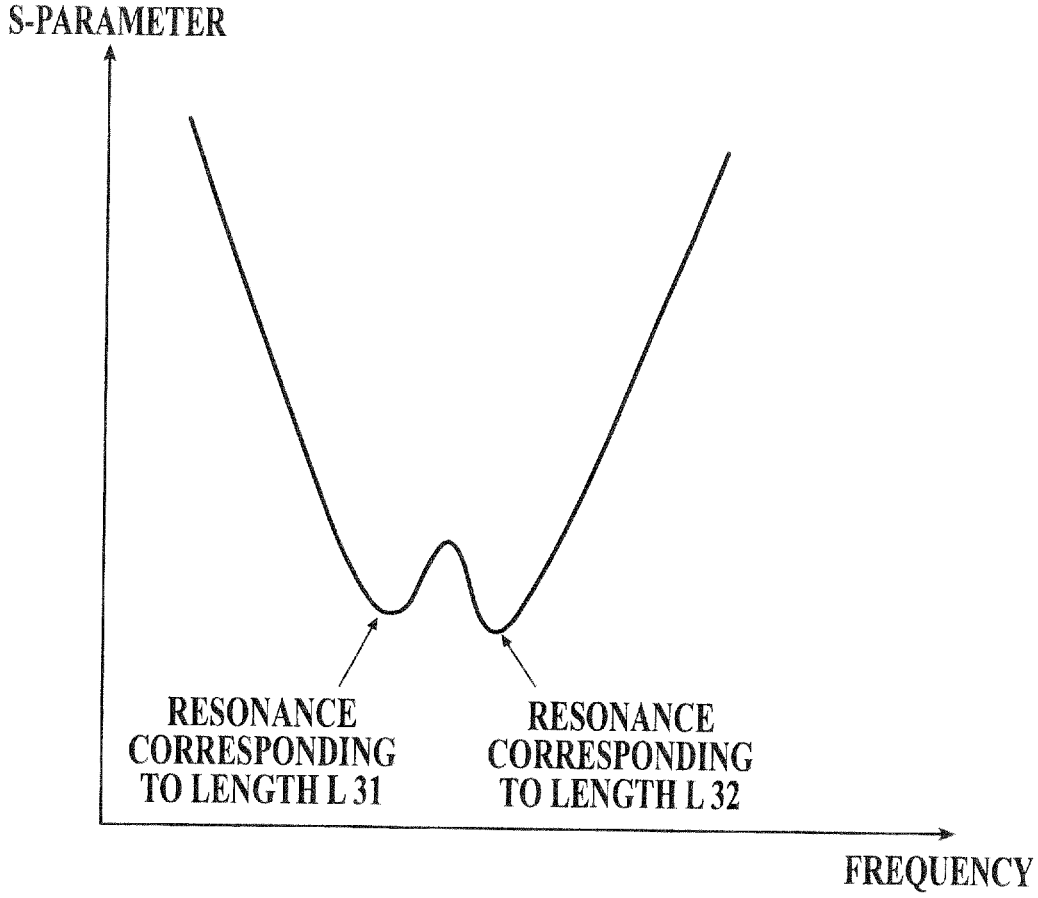
FIG. 13 is a graph indicating relation between frequencies and scattering parameters (S-parameters) in the multiband antenna of the first embodiment.

Next, band widening of a resonance point of the multiband antenna 30 will be described with reference to FIGS. 12 and 13. FIG. 12 illustrates lengths of sides of each antenna element 511, 513. FIG. 13 illustrates relation between frequencies and S-parameters in the multiband antenna 30.

As illustrated in FIG. 12, in the multiband antenna 30, the antenna elements 511, 513 respectively have a shape of which width becomes large with increase of the distance from the short stub 512. The length of the upper side of the antenna element 511 is denoted by L31 and the length of the lower side of the antenna element 511 is denoted by L32. Here, the length L31 is larger than the length L32. Further, the length of the upper side of the antenna element 513 is denoted by L41 and the length of the lower side of the antenna element 513 is denoted by L42. Here, the length L42 is larger than the length L41.

As illustrated in FIG. 7, the antenna current flows through the antenna element 511 at the time of resonance in the first resonance frequency band. Here, the antenna current flows on the upper side (having the length L31) and the lower side (having the length L32) of the antenna element 511 owing to a skin effect. Accordingly, as illustrated in FIG. 13, a resonance section corresponding to the length L31 and a resonance section corresponding to the length L32 appear on the relation of the S-parameters against the resonance frequencies in the first resonance frequency band. Therefore, the resonance frequency band can be widened owing to the two resonance sections for the first resonance frequency band.

Similarly, the antenna current flows through the antenna element 513 at the time of resonance in the second resonance frequency band. Here, the antenna current flows on the upper side (having the length L41) and the lower side (having the length L42) of the antenna element 511. Accordingly, there appears a resonance section corresponding to the length L42 and a resonance section corresponding to the length L41. Therefore, the resonance frequency band can be widened owing to the two resonance sections for the second resonance frequency band, as well.

As described above, according to the present embodiment, the multiband antenna 30 is provided with the dielectric portion 40, the film antenna portion 50 where the antenna conducting portion 50B is formed on the insulating film 50A and which is arranged around the dielectric portion 40, the double-faced tape 60 which fixes the film antenna portion 50 and the dielectric portion 40 to each other with a certain distance therebetween. Accordingly, the effective relative permittivity of the dielectric portion 40 can be varied by varying thickness of the double-faced tape 60, so that adjustment of the resonance frequency in the multiband antenna 30 can be easily performed.

Further, the film antenna portion 50 is the multiband inverted F antenna having the ground portion 52, the antenna elements 511, 513, and the short stubs 512, 514, 515. The film antenna portion 50 includes the impedance-matching loop route R22 corresponding to the second resonance frequency band (i.e., the high resonance frequency band) and the impedance-matching loop route R12 corresponding to the first resonance frequency band (i.e., the low resonance frequency band). Accordingly, the impedance of the resonance section in the second resonance frequency band can be matched approximately to 50Ω and the impedance of the resonance section in the first resonance frequency band can be matched approximately to 50Ω by adjusting the lengths of the two impedance-matching loop routes R12, R22 with the lengths L1, L2.

Further, the antenna element 511 corresponding to the first resonance frequency band includes the two sides, whose lengths L31 and L32 are different from each other, between the portion of the antenna element 511 connected to the short stub 512 and the other end thereof. The antenna element 513 corresponding to the second resonance frequency band includes the two sides, whose lengths L41 and L42 are different from each other, between the portion of the antenna element 513 connected to the short stub 512 and the other end thereof. Accordingly, it is possible to make the widths of the first resonance frequency band and the second resonance frequency band wider.

Further, the dielectric portion 40 has a substantially rectangular-parallelepiped shape. Accordingly, it is possible to easily form the dielectric portion 40.

Further, the dielectric portion 40 has a substantially rectangular-parallelepiped shape which corresponds to a place where the dielectric portion 40 is attached. Accordingly, it is possible to downsize the multiband antenna 30 and the handheld terminal 1.

Further, the dielectric portion 40 includes the round-shaped edge portion 42 which corresponds to deformation of the film antenna portion 50. Accordingly, it is possible to stick the film antenna portion 50 to the dielectric portion 40 without a gap.

Further, the handheld terminal 1 is provided with the multiband antenna 30, the radio communication unit 16 which performs communication via the multiband antenna 30, and the CPU 11 which controls the radio communication unit 16. Accordingly, it is possible to perform radio communication at a desired resonance frequency by adjusting resonance frequency with the multiband antenna 30.

Further, the ground portion 52 of the film antenna portion 50 is connected to the frame ground of which size in the longitudinal direction is equal to or larger than λ/4 of the center frequency in the low resonance frequency band and of which width is equal to or larger than λ/4 of the center frequency in the high resonance frequency band. Accordingly, the area of the ground portion 52 can be relatively small and the ground portion 52 can surely function as the ground of the multiband antenna.

First Modified Example

Figure 14:
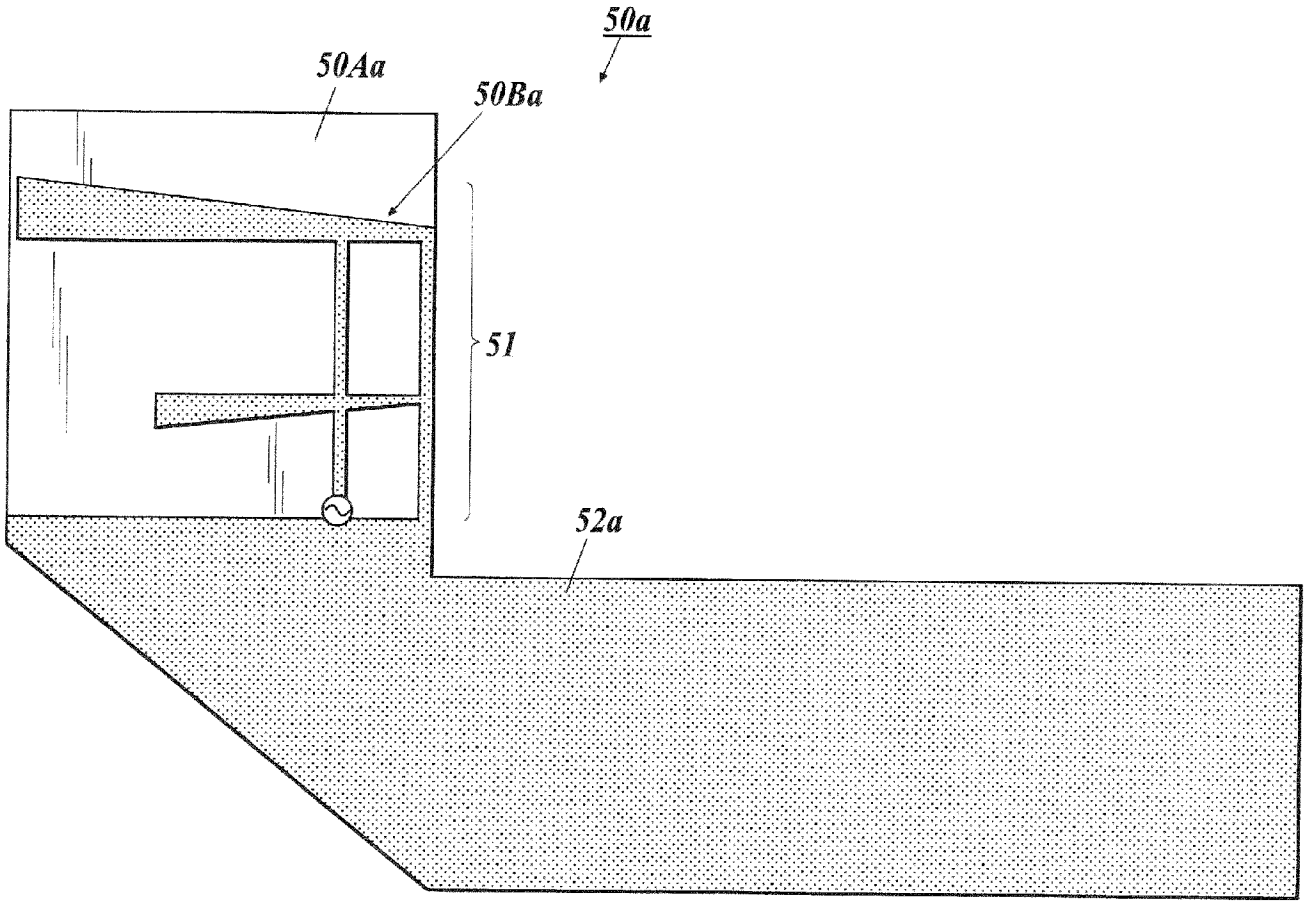
FIG. 14 illustrates a plane structure of a film antenna portion of a first modified example of the first embodiment.

A first modified example of the first embodiment will be described with reference to FIG. 14. FIG. 14 illustrates a plane structure of a film antenna portion 50*a*.

A device of the present modified example is configured so that the film antenna portion 50 of the multiband antenna 30 of the above embodiment is replaced with a film antenna portion 50*a*. Here, explanation is made mainly on the film antenna portion 50*a*.

The film antenna portion 50*a* illustrated in FIG. 14 includes a film 50Aa and an antenna conducting portion 50Ba. The antenna conducting portion 50Ba includes an antenna element portion 51 and a ground portion 52*a*.

The film antenna portion 50 of the first embodiment is configured so that the ground portion 52 is connected to the frame ground in the case 2. Meanwhile, in the film antenna portion 50*a* of the present modified example, the ground portion 52*a* is not connected to the frame ground in the case 2 but has required ground area. Further, the film 50Aa has a shape and a size which correspond to the antenna element portion 51 and the ground portion 52*a*. The dielectric portion 40 has a shape and a size that allow at least the antenna element portion 51 to be stuck thereto.

The length of the ground portion 52*a* in the longitudinal direction is equal to or larger than 8.4 cm which is λ/4 of the center frequency 892 MHz at the 800 MHz band and the width thereof (shorter side) is equal to or larger than 4 cm which is λ/4 of the center frequency 1850 MHz at the 1800 MHz band. Accordingly, area necessary for the ground of the multiband antenna is ensured by the ground portion 52*a*.

As described above, according to the present modified example, the ground portion 52*a* of the film antenna portion 50*a* has a length in the longitudinal direction equal to or larger than λ/4 of the center frequency in the low resonance frequency band and has a width equal to or larger than λ/4 of the center frequency in the high resonance frequency band. Accordingly, the ground portion 52*a* can surely function as the ground of the multiband antenna without being connected to the frame ground.

Second Modified Example

Figure 15:
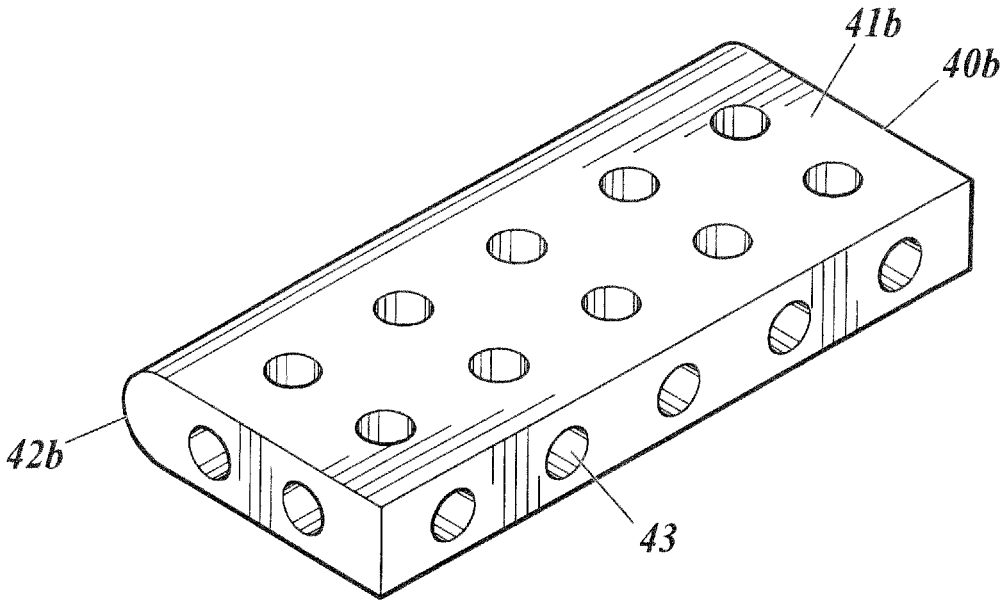
FIG. 15 is a perspective view of a dielectric portion of a second modified example of the first embodiment.
Figure 16:
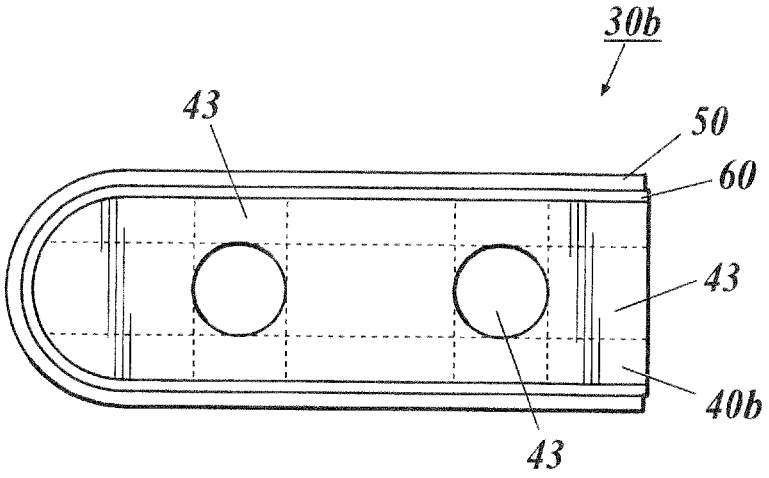
FIG. 16 is a side view of the dielectric portion of the second modified example.

A second modified example of the first embodiment will be described with reference to FIGS. 15 and 16. FIG. 15 illustrates a perspective structure of a dielectric portion 40*b*. FIG. 16 illustrates a side face structure of the dielectric portion 40*b*.

A device of the present modified example is configured so that the multiband antenna 30 having the dielectric portion 40 according to the first embodiment is replaced with a multiband antenna 30*b* having the dielectric portion 40*b*. Here, explanation is made mainly on the structure of the dielectric portion 40*b*.

As illustrated in FIG. 15, the dielectric portion 40*b* includes a block body section 41*b*. In the block body section 41*b*, an edge portion 42*b* and hole portions 43 as a first space portion are formed. As illustrated in FIG. 16, the multiband antenna 30*b* includes the dielectric portion 40*b*, a film antenna portion 50, and a double-faced tape 60 which sticks the film antenna portion 50 to the dielectric portion 40*b*.

A plurality of the hole portions 43 are arranged. Each hole portion 43 vertically penetrates a flat face or a side face of the block body section 41*b*. In the dielectric portion 40*b*, the effective relative permittivity of the dielectric portion 40*b* can be controlled by varying volume of space of the hole portions 43 in the block body section 41*b*. That is, the effective relative permittivity of the dielectric portion 40*b* can be controlled by varying a dielectric amount against the volume of the block body section 41*b*. Here, the structure of a space portion in the block body section of the dielectric portion is not limited to the structure of the above-mentioned hole portions 43. Alternatively, a single hole portion 43 may be formed or another type of space portion such as a hole portion which does not penetrate may be formed.

As described above, according to the present modified example, the dielectric portion 40*b* includes the plurality of hole portions 43. Accordingly, adjustment of the effective relative permittivity of the dielectric portion 40*b* can easily be made in accordance with the volume of the hole portions 43 against the volume of dielectric resin of the dielectric portion 40*b*, in addition to adjustment of thickness of the double-faced tape 60. Alternatively, the thickness of the double-faced tape 60 may be fixed, and the effective relative permittivity of the dielectric portion 40*b* may be adjusted by varying the volume of the hole portions 43 against the volume of dielectric resin of the dielectric portion 40*b*.

Second Embodiment

A second embodiment according to the present invention will be described with reference to FIGS. 17 to 24. In the present embodiment, the same numeral is given to the same part as the device structure of the first embodiment and explanation thereof will not be repeated.

First, a device structure of the present embodiment will be described with reference to FIGS. 17 to 20.

Figure 17A:
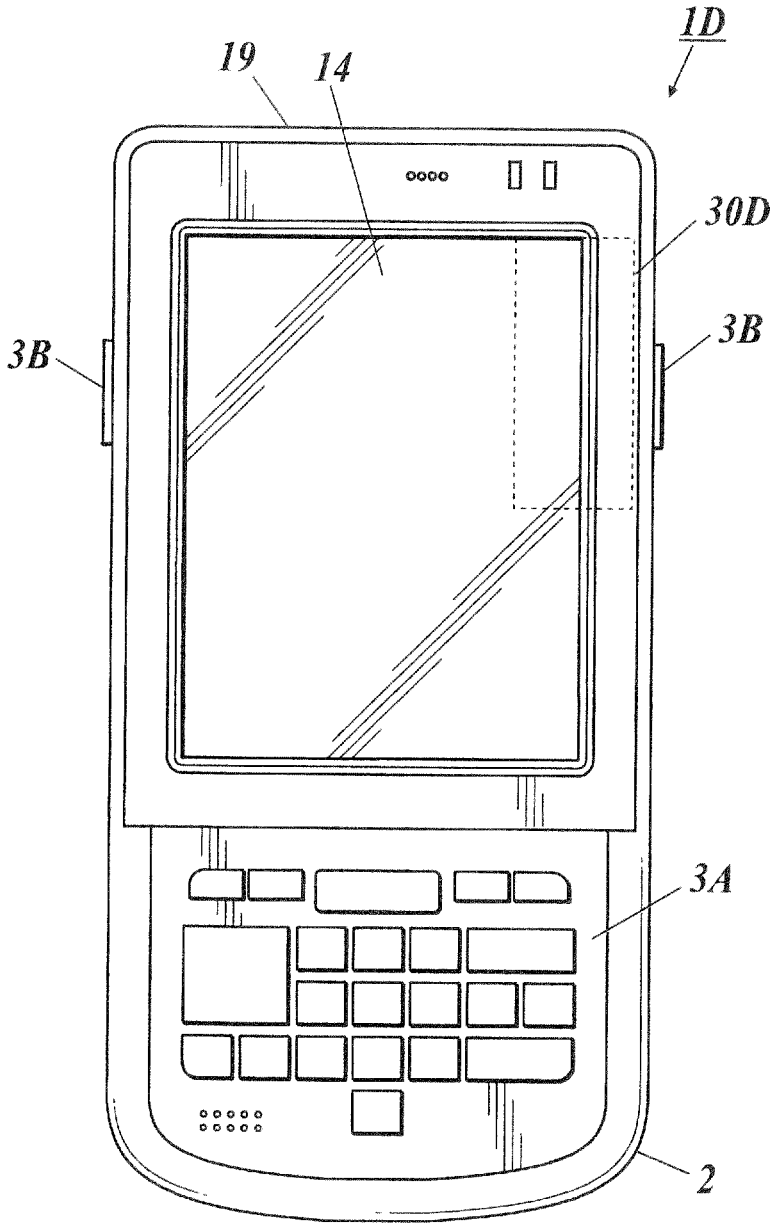
FIG. 17A is a front view of a handheld terminal of a second embodiment according to the present invention.

FIG. 17A illustrates a front face structure of a handheld terminal 1D of the present embodiment.

Figure 17B:
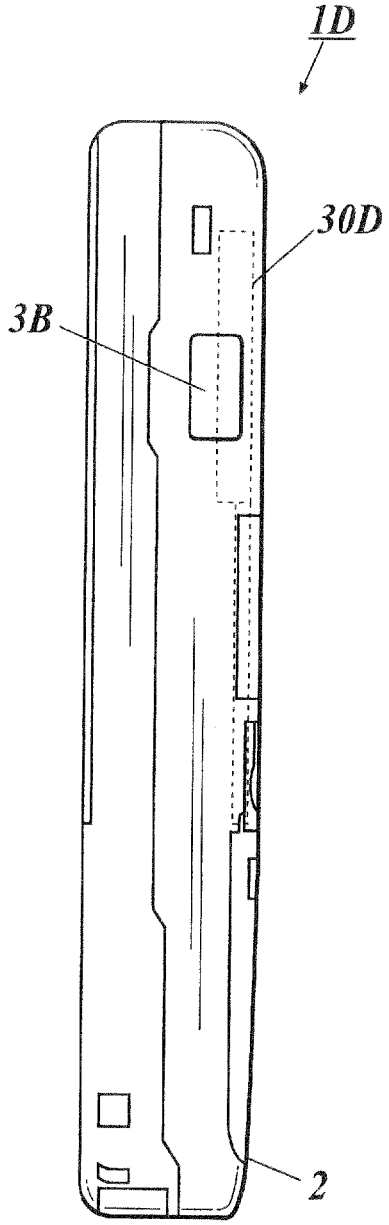
FIG. 17B is a side view of the handheld terminal of the second embodiment.

FIG. 17B illustrates aside face structure of the handheld terminal 1D.

Figure 17C:
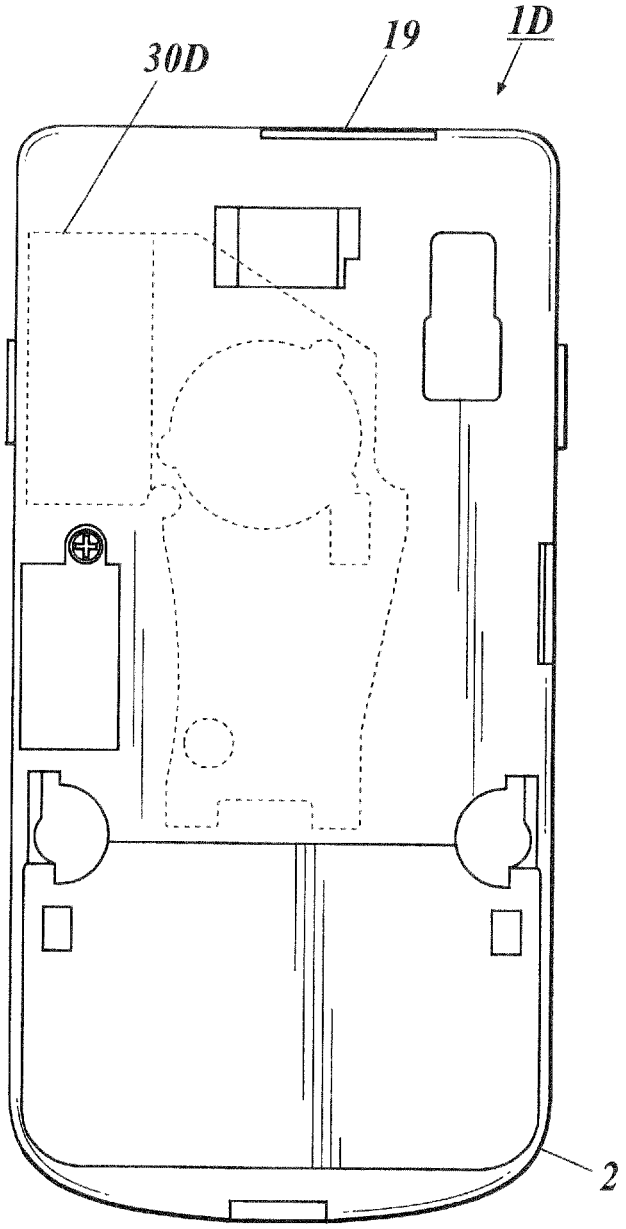
FIG. 17C is a back view of the handheld terminal of the second embodiment.

FIG. 17C illustrates a back face structure of the handheld terminal 1D.

Figure 18:
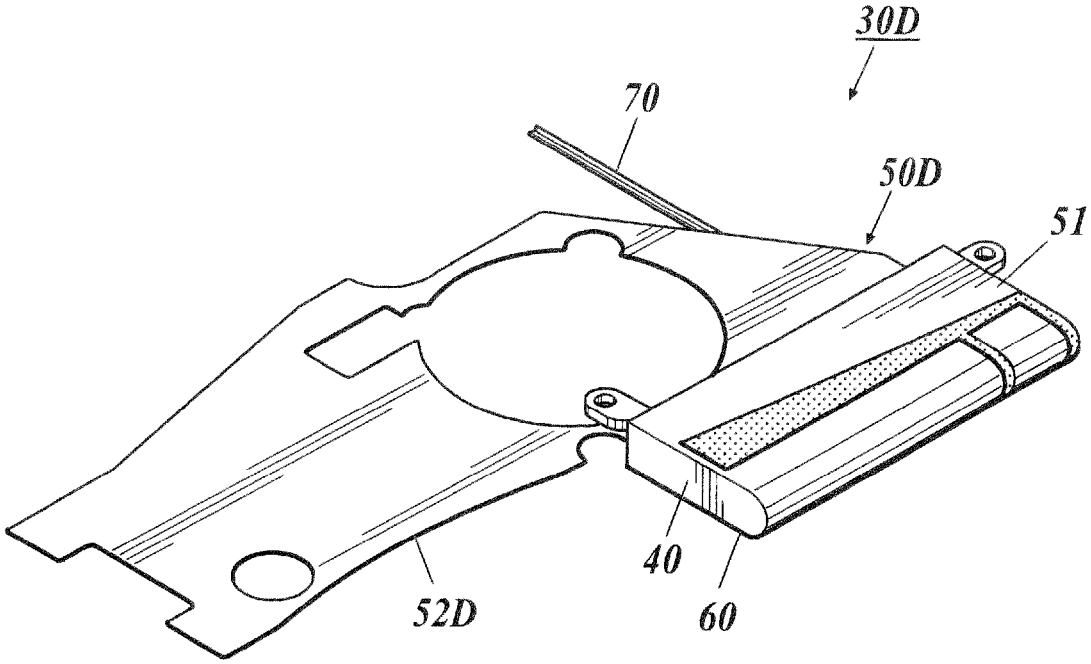
FIG. 18 is a perspective view of a multiband antenna of the second embodiment.

FIG. 18 illustrates a perspective structure of a multiband antenna 30D.

Figure 19:
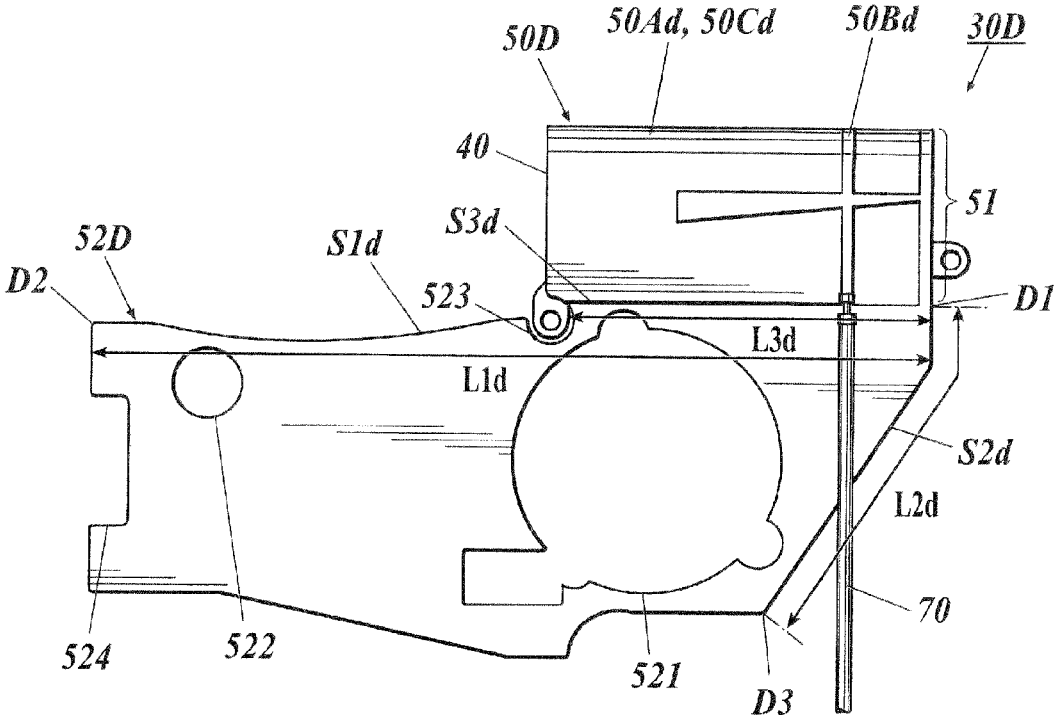
FIG. 19 is a plane view of the multiband antenna of the second embodiment.

FIG. 19 illustrates a front face structure of the multiband antenna 30D.

Figure 20:
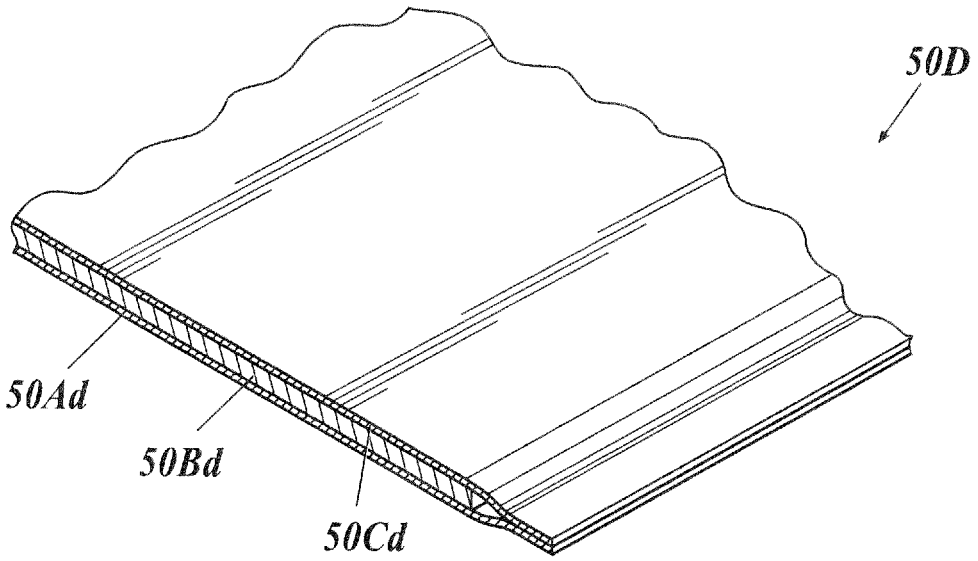
FIG. 20 is a view illustrating a sectional structure of an end section of the multiband antenna of the second embodiment.

FIG. 20 illustrates a sectional structure of an end section of the multiband antenna 30D.

In the handheld terminal 1D of the present embodiment, the multiband antenna 30 of the handheld terminal 1 of the first embodiment is replaced with the multiband antenna 30D. Similarly to the handheld terminal 1, the handheld terminal 1D has the inputting and storing function of information, the scanner function, the radio LAN communication function, and the cellular phone communication function. Here, the cellular phone communication function is obtained with the GSM method and a wideband code division multiple access (WCDMA) method. Further, the multiband antenna 30D is further improved from the multiband antenna of the first modified example.

Similarly to the handheld terminal 1, the handheld terminal 1D is provided with a case 2, a variety of keys 3A, trigger keys 3B, a display unit 14, a scanner unit 19 and the like, as illustrated in FIGS. 17A to 17C. Further, the handheld terminal 1D is provided with the multiband antenna 30D at the inside of the case 2. The handheld terminal 1D has a function structure in which the multiband antenna 30 is replaced with the multiband antenna 30D in the handheld terminal 1 illustrated in FIG. 2. The radio communication unit 16 is a radio communication unit which performs cellular phone communication with the GSM method and the WCDMA method.

Next, a structure of the multiband antenna 30D will be described with reference to FIGS. 18 to 20.

As illustrated in FIG. 18, the multiband antenna 30D includes a dielectric portion 40, a film antenna portion 50D and a double-faced tape 60. The film antenna portion 50D includes an antenna element portion 51 and a ground element 52D. That is, the film antenna portion 50D has a structure in which the ground portion 52 of the film antenna portion 50 is replaced with the ground element 52D. The dielectric portion 40 is stuck to the antenna element portion 51 of the film antenna portion 50D via the double-faced tape 60.

As illustrated in FIG. 19, the film antenna portion 50D of the multiband antenna 30D includes a film 50Ad as an insulating layer (i.e., an insulating material), an antenna conducting portion 50Bd which is conductive, and a film 50Cd as an insulating layer (i.e., an insulating material). The film 50Ad, the antenna conducting portion 50Bd and the film 50Cd are laminated into three layers in this order. The film to which the coaxial cable 70 is attached is denoted by the film 50Ad. The film 50Ad has a hole portion at a section where the coaxial cable 70 (i.e., the core wire 71 and the external conducting body 73) and the antenna conducting portion 50Bd are connected with each other by soldering. Similarly to FIG. 6, the core wire 71 is electrically connected to the antenna conducting portion 50Bd of the antenna element portion 51 via the hole portion. The external conducting body 73 is electrically connected to the antenna conducting portion 50Bd of the ground element 52D via the hole portion.

Further, as illustrated in FIG. 20, at the end section of the film antenna portion 50D, the films 50Ad and 50Cd respectively have a larger plane than that of the antenna conducting portion 50Bd. That is, the films 50Ad and 50Cd are mutually stuck at the end section of the film antenna portion 50D. Accordingly, the antenna conducting portion 50Bd is entirely covered with the films 50Ad and 50Cd at the end section. Thus, the antenna conducting portion 50Bd is entirely insulated from the outside by the films 50Ad and 50Cd except for the hole portion for connection with the coaxial cable 70. In this manner, the film antenna 50D (the ground element 52D) is not electrically connected to the frame ground of the case 2 or the ground of a substrate.

Further, as illustrated in FIG. 19, the ground element 52D includes hole portions 521, 522 and cutout portions 523, 524 as a second space portion. The hole portion 521 is a hole portion which is arranged at a position avoiding internal components such as a button battery and a pole of the case 2 when the multiband antenna 30D is attached into the case 2 of the handheld terminal 1D. Similarly to the hole portion 521, the hole portion 522 and the cutout portions 523, 524 are a hole portion and cutout portions, respectively, which are arranged at positions avoiding internal components.

As in FIG. 19, endpoints D1, D2, D3 are formed on the ground element 52D.

The end point D1 is an end point of a connection section between the antenna element portion 51 and the ground element 52D. The end point D2 is an end point located opposite to the antenna element 51 in the longitudinal direction on the ground element 52D. The end point D3 is an end point of one of the corners of the ground element 52D. A side between the endpoint D1 and the end point D2 is denoted by S1*d*. The length of the side S1*d* is denoted by distance L1*d*. A side between the end point D1 and the end point D3 is denoted by S2*d*. The length of the side S2*d* is denoted by distance L2*d*. Aside between the endpoint D1 and the cutout portion 523 is denoted by S3*d*. The length of the side S3*d* is denoted by distance L3*d*. The lengths L1*d*, L2*d*, L3*d* correspond to resonance frequencies of the multiband antenna 30D and will be described later in detail.

Next, operation of the handheld terminal 1D will be described with reference to FIGS. 21 to 24. The operation of the handheld terminal 1D other than the multiband antenna 30D is the same as that of the handheld terminal 1.

Figure 21:
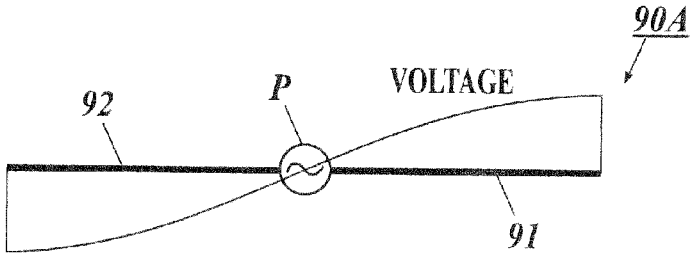
FIG. 21 is a view illustrating a dipole antenna and voltage distribution thereof.
Figure 22:
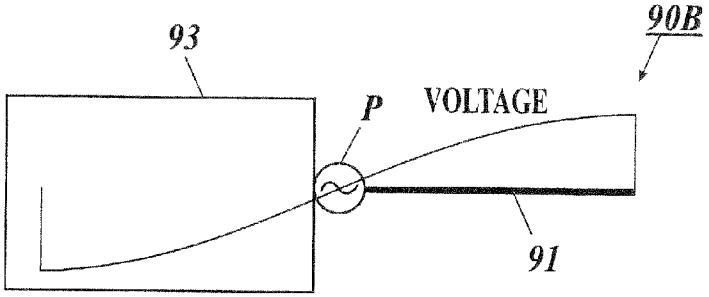
FIG. 22 is a view illustrating a monopole antenna and a metal portion and voltage distribution thereof.
Figure 23:
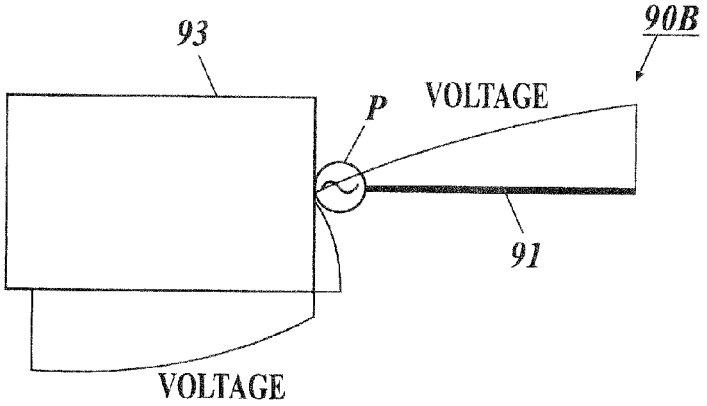
FIG. 23 is a view illustrating the monopole antenna and the metal portion and actual voltage distribution thereof.

First, the reason why the ground element 52D is required for the multiband antenna 30 will be described with reference to FIGS. 21 to 23. FIG. 21 illustrates a dipole antenna 90A and voltage distribution thereof. FIG. 22 illustrates a monopole antenna 90B and a metal portion 93 and voltage distribution thereof. FIG. 23 illustrates the monopole antenna 90B and the metal portion 93 and actual voltage distribution thereof.

As illustrated in FIG. 21, the general dipole antenna 90A includes a radiant element 91 and a ground element 92. The radiant element 91 and the ground element 92 respectively have a length of λ/4. Here, λ denotes a wavelength of a radio wave utilized for communication. In the dipole antenna 90A, when resonance occurs, voltage is generated at the radiant element 91 and the ground element 92 and thereby the resonance is balanced with a power feeding point P sandwiched, and then, the radio wave having a wavelength of λ is transmitted and received.

As illustrated in FIG. 22, the general monopole antenna 90B includes the radiant element 91. Since the ground element 92 is not provided, the monopole antenna 90B utilizes the metal portion 93 of a chassis to which the monopole antenna 90B is attached as the ground. Accordingly, in the monopole antenna 90B, when resonance occurs, voltage is generated at the radiant element 91 and the metal portion 93 and thereby the resonance is balanced with the power feeding point P sandwiched, and then, the radio wave having a wavelength of λ is transmitted and received.

Actually, current flowing through the metal portion 93 is converged to an edge. Accordingly, as illustrated in FIG. 23, when an edge exists in the metal portion 93 at the vicinity of a route of current corresponding to the voltage of the radiant element 91, current flows through the edge and voltage is generated as well.

In the monopole antenna 90B, if an edge having a length corresponding to λ/4 of the frequency to be used is intentionally arranged at the metal portion 93, which is the ground portion, antenna gain can be increased because ground current flows more easily when resonance occurs at the frequency. Not limited to a monopole antenna, the principle is common to all antenna types which count chassis metal without having the ground.

Accordingly, the above principle similarly works for an inverted F antenna counting chassis ground. In a case of a multiband antenna with plurally occurring resonance, the similar effect can be obtained at a plurality of resonance frequencies by arranging edges having lengths corresponding to the respective frequencies at the ground.

In the multiband antenna 30D of the present embodiment, the ground element 52D with sides having a plurality of lengths is arranged at the antenna element portion 51 (as well as the dielectric portion 40 and the double-faced tape 60) which is a multiband inverted F antenna downsized with the dielectric portion 40. In the multiband antenna 30D, the antenna gain is increased by making the ground element 52D resonate at frequencies of the sides having the respective lengths.

The multiband antenna 30D is an antenna for cellular phone communication of the GSM method and the WCDMA method. A frequency band of the GSM method is between 824 MHz and 960 MHz and between 1710 MHz and 1990 MHz. The upper limit of a frequency band of the WCDMA method is 2170 MHz.

The lengths L1*d*, L2*d*, L3*d* of the sides S1*d*, S2*d*, S3*d* of the ground element 52D of the multiband antenna 30D illustrated in FIG. 19 are determined so as to generate resonance at the frequency bands of the GSM method and the WCDMA method. Here, an expression of L1*d*>L2*d*>L3*d* is satisfied.

The length L1*d* of the side S1*d* of the ground element 52D is set to be 8.4 cm which corresponds to λ/4 of the radio wave of 892 MHz.

The length L2*d* of the side S2*d* of the ground element 52D is set to be 4.05 cm which corresponds to λ/4 of the radio wave of 1850 MHz.

The length L3*d* of the side S3*d* of the ground element 52D is set to be 3.4 cm which corresponds to λ/4 of 2170 MHz.

Figure 24:
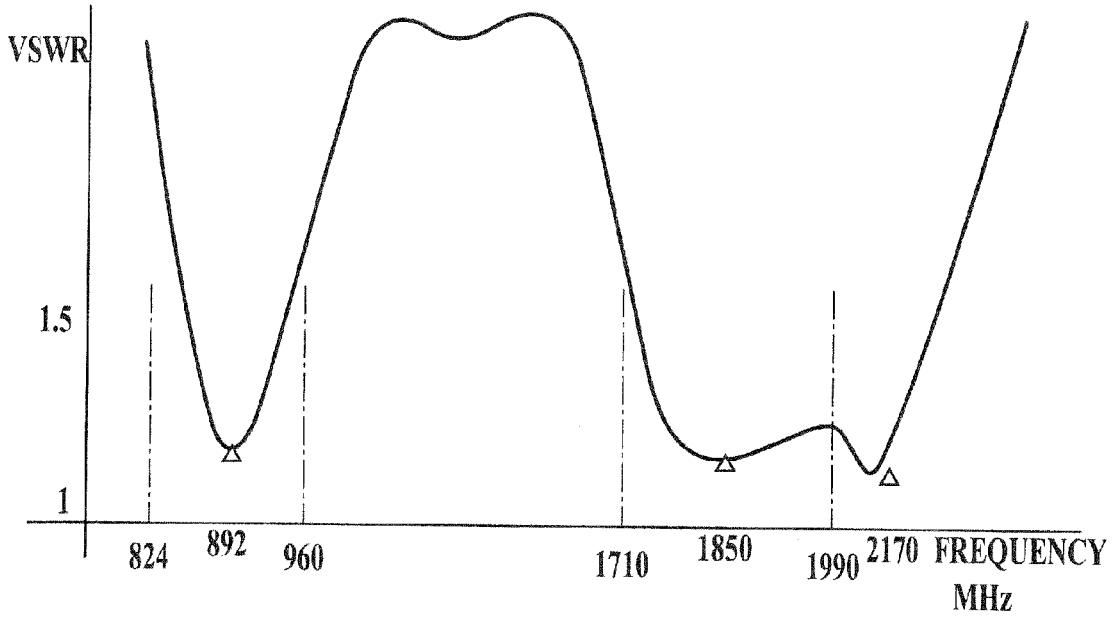
FIG. 24 is a view illustrating a voltage standing wave ratio (VSWR) against a frequency of the multiband antenna of the second embodiment.

FIG. 24 illustrates a VSWR against the frequency of the multiband antenna 30D.

FIG. 24 illustrates the VSWR simulated against the frequency of the multiband antenna 30D. The resonance frequencies of 892 MHz and 1850 MHz corresponding to the sides S1*d* and S2*d* are at the center of the bandwidths to be used, respectively, which means that the antenna gain can be increased. The resonance frequency of 2170 MHz corresponding to the side S3*d* is very close to the outer edge of the bandwidth to be used, which means that the antenna resonance width can be enlarged.

As described above, the present embodiment provides the effect similar to that of the handheld terminal 1 and the multiband antenna 30 of the first embodiment. Similarly to the multiband antenna of the first modified example, the multiband antenna 30D includes the ground element 52D with the sides S1*d*, S2*d*, S3*d* having lengths which cause resonance at the frequencies corresponding to the resonance frequency bands of the antenna element portion 51. Accordingly, it is possible that the multiband antenna 30D has a structure without utilizing the frame ground or the ground of a PCB (i.e., an electric circuit). Therefore, stable resonance can be obtained without being influenced by a chassis structure, and high antenna gain can be obtained.

Specifically, even in the case that a frame shape is varied owing to mid-course design change and the like of the handheld terminal 1D, it is possible to prevent influence on antenna performance (i.e., antenna gain and directionality).

Here, resonance occurs between the ground element 52D and the antenna element portion 51 without utilizing the frame ground and the ground of the PCB (i.e., the electric circuit). Accordingly, it is possible to reduce current flowing through the chassis of the handheld terminal 1, so that influence of an electromagnetic field to a human body such as a head can be reduced. In addition, it is possible to reduce variation of antenna characteristics caused by variation of ground area under the influence of a human body such as a hand holding the frame of the handheld terminal 1D.

The multiband antenna 30D includes the sides S1*d*, S2*d*, S3*d* in the ground element 52D, which sides have lengths to make the ground element 52D resonate at three frequencies. Accordingly, it is possible to ensure stable gain as a multiband antenna resonating at three frequencies.

In particular, since the ground element 52D resonates at the sides S1*d* and S2*d* corresponding to two resonance frequency bands of the antenna element portion 51, the antenna gain can be increased.

That is, the length L1*d* of the side S1*d* of the ground element 52D is set to be 8.4 cm corresponding to λ/4 of the radio wave of 892 MHz which corresponds to the first resonance frequency band of the antenna element portion 51. The length L2*d* of the side S2*d* of the ground element 52D is set to be 4.05 cm corresponding to λ/4 of the radio wave of 1850 MHz which corresponds to the second resonance frequency band of the antenna element portion 51. Accordingly, the ground element 52D resonates similarly to the antenna element portion 51, and as a result, the antenna gain can be increased.

Further, the length L3*d* of the side S3*d* of the ground element 52D is set to be 3.4 cm corresponding to λ/4 of the radio wave of 2170 MHz which is close to the second resonance frequency band of the antenna element portion 51. Accordingly, since the side S3*d* of the ground element 52D resonates at the resonance frequency 2170 KHz which is close to the resonance frequency 1850 MHz of the side S2*d* of the ground element 52D, it is possible to widen the band width of the resonance frequency of the multiband antenna 30D.

In the multiband antenna 30D, the ground element 52D includes the hole portions 521, 522 and the cutout portions 523, 524 arranged at the positions avoiding internal components. Accordingly, the multiband antenna 30D can be mounted at interspace of the chassis without disposing dedicated space for the multiband antenna 30D in the handheld terminal 1. Hence, the handheld terminal 1D can be downsized.

The ground element 52D (the film antenna portion 50D) of the multiband antenna 30D is provided with the films 50Ad and 50Cd which are the insulating layers on both surfaces of the antenna conducting portion 50Bd. Accordingly, the antenna conducting portion 50Bd of the ground element 52D can be insulated from the outside and short circuits to a PCB (i.e., an electric circuit) and a frame ground can be avoided. Hence, the multiband antenna 30D can be mounted on a small-sized device (i.e., the handheld terminal 1D).

As the multiband antenna 30D, the antenna element portion 51 and the ground element 52D are formed by one sheet of a FPC. Accordingly, it is possible to prevent deterioration of the antenna performance due to poor contact between the antenna element portion 51 and the ground element 52D.

Here, the description of the respective embodiments and the modified examples are only examples of the multiband antenna and the electronic device according to the present invention. The present invention is not limited thereto.

For example, it is also possible to appropriately combine at least two of the embodiments and modified examples. Further, in the embodiments and modified examples, a handheld terminal is utilized as an electronic device. However, another electronic device such as a PDA and a cellular phone may be used.

In the first embodiment and the modified examples, the film antenna portion 50 of the multiband antenna 30 has the structure in which the film 50A and the antenna conducting portion 50B are formed in two layers in this order next to the dielectric portion 40 (i.e., the structure in which the film 50A is stuck to the dielectric portion 40 with the double-faced tape 60). However, the present invention is not limited thereto. For example, the film antenna portion of the multiband antenna may have a structure in which the antenna conducting portion and the film are formed in two layers in this order next to the dielectric portion (i.e., a structure in which the antenna conducting portion is stuck to the dielectric portion with the double-faced tape). Alternatively, the film antenna portion may be formed into three layers and the like in such a way that an insulating layer such as a film etc. is formed on an antenna conducting portion which is formed on a film.

In the respective embodiments and the modified examples, the double-faced tape 60 is utilized as the separating portion. However, not limited thereto, it is also possible to utilize another separating portion such as a dual glue film as the separating portion.

In the second embodiment, the ground element 52D includes the sides S1*d*, S1*d*, S3*d* which resonate at three frequencies. However, not limited thereto, the antenna element may include a plurality of sides which resonate at two or four frequencies or more, for example.

Further, in the respective embodiments and the modified examples, the GSM method and the WCDMA method are adopted as the communication method of the multiband antenna. However, not limited thereto, it is also possible to adopt another communication method.

Naturally, the detailed structure and detailed operation of the multiband antenna and the handheld terminal as the electronic device in the respective embodiments and the modified examples can be appropriately modified without departing from the scope of the present invention.

INDUSTRIAL APPLICABILITY

As described above, the multiband antenna and the electronic device according to the present invention are appropriate to multiband radio communication.

REFERENCE NUMERALS

1, 1D handheld terminal
2 case
3A variety of keys
3B trigger key
11 CPU
12 input unit
13 RAM
14 display unit
15 ROM
16 radio communication unit
17 flash memory
18*a* antenna
18 radio LAN communication unit
19 scanner unit
20 I/F
21 bus
30, 30*b*, 30D multiband antenna
40, 40*b* dielectric portion
41, 41*b* block body section
42, 42*b* edge portion
43 hole portion
50, 50*a*, 50D film antenna portion
50A, 50Aa, 50Ad, 50Cd film
50B, 50Ba, 50Bd antenna conducting portion

51 antenna element portion
511, 513 antenna element
512, 514, 515 short stub
52, 52*a* ground portion
52D ground element
521, 522 hole portion
523, 524 cutout portion
S1*d*, S2*d*, S3*d* side
P power feeding point
60 double-faced tape
70 coaxial cable
71 core wire
72 insulating material
73 external conducting body
74 protection cover portion
80 inverted F antenna
90A dipole antenna
90B monopole antenna
91 radiant element
92 ground element
93 metal portion

The invention claimed is:

1. A multiband antenna comprising:

a conductive antenna element portion and a conductive ground element portion which are provided on an insulating film, wherein:

the antenna element portion includes a first antenna element having a length corresponding to a first resonance frequency, and a second antenna element having a length corresponding to a second resonance frequency; and the ground element portion includes a first side having a length to resonate at the first resonance frequency, and a second side having a length to resonate at the second resonance frequency.

2. The multiband antenna according to claim 1, further comprising a dielectric portion, wherein the antenna element portion is arranged around the dielectric portion.

3. The multiband antenna according to claim 2, further comprising a separating portion which fixes the antenna element portion and the dielectric portion to each other with a certain distance therebetween.

4. The multiband antenna according to claim 2, wherein the dielectric portion has a substantially rectangular-parallelepiped shape.

5. The multiband antenna according to claim 2, wherein the dielectric portion has a shape corresponding to a place where the dielectric portion is attached.

6. The multiband antenna according to claim 2, wherein the dielectric portion includes an edge portion having a curved surface which corresponds to deformation of the antenna element portion.

7. The multiband antenna according to claim 2, wherein the dielectric portion includes at least one first space portion.

8. The multiband antenna according to claim 1, wherein the antenna element portion is an inverted F antenna having a plurality of resonance frequency bands, and the antenna element portion includes a plurality of impedance-matching loop routes.

9. The multiband antenna according to claim 1, wherein the antenna element portion includes:

a first short stub which is connected to the ground element portion;

a second short stub which is arranged separately from the first short stub by a predetermined distance and which is connected to the first antenna element and the second antenna element; and a third short stub which is arranged separately from the first short stub by a predetermined distance and which is connected to a power feeding point and the second antenna element, wherein one end of the first antenna element is connected to one end of the first short stub; and wherein the second antenna element is arranged between the ground element portion and the first antenna element, with one end of the second antenna element connected to the first short stub.

10. The multiband antenna according to claim 9, wherein:

the first antenna element includes two sides, whose lengths are different from each other, between the one end of the first antenna element and the other end thereof; and the second antenna element includes two sides, whose lengths are different from each other, between the one end of the second antenna element and the other end thereof.

11. The multiband antenna according to claim 1, wherein:

the first side of the ground element portion has a length equal to or larger than $\lambda/4$ of a center frequency of a first resonance frequency band; and the second side, which is a shorter side, of the ground element portion has a length equal to or larger than $\lambda/4$ of a center frequency of a second resonance frequency band, wherein $\lambda$ denotes a wavelength of a radio wave.

12. The multiband antenna according to claim 1, wherein the ground element portion includes a second space portion arranged at a position avoiding an internal component of an electronic device to which the multiband antenna is attached.

13. The multiband antenna according to claim 1, wherein both faces of the antenna element portion and the ground element portion are covered with the film.

14. The multiband antenna according to claim 1, wherein the antenna element portion and the ground element portion are on a single film.

15. An electronic device, comprising:

the multiband antenna according claim 1;

a communication unit which performs radio communication with an external device via the multiband antenna; and a control unit which controls the communication unit.

16. A multiband antenna comprising:

a conductive antenna element portion and a conductive ground element portion which are provided on an insulating film, wherein the antenna element portion includes a first antenna element having a length corresponding to a first resonance frequency, and a second antenna element having a length corresponding to a second resonance frequency;

wherein the ground element portion includes a first side having a length to resonate at the first resonance frequency, and a second side having a length to resonate at the second resonance frequency;

wherein the antenna element portion further includes:

a first short stub which is connected to the ground element portion;

a second short stub which is arranged separately from the first short stub by a predetermined distance and which is connected to the first antenna element and the second antenna element; and a third short stub which is arranged separately from the first short stub by a predetermined distance and which is connected to a power feeding point and the second antenna element;

wherein one end of the first antenna element is connected to one end of the first short stub; and wherein the second antenna element is arranged between the ground element portion and the first antenna element, with one end of the second antenna element connected to the first short stub.

* * * * *